US011352189B2

(12) United States Patent
Hammerschmidt et al.

(10) Patent No.: US 11,352,189 B2
(45) Date of Patent: Jun. 7, 2022

(54) RETENTION PACKAGING ASSEMBLY WITH SEPARATE COMPONENTS

(71) Applicant: Sealed Air Corporation (US), Charlotte, NC (US)

(72) Inventors: Christof Hammerschmidt, Wiesbaden (DE); Devin Ridgeway, Chula Vista, CA (US)

(73) Assignee: Sealed Air Corporation (US), Charlotte, NC (US)

( * ) Notice: Subject to any disclaimer, the term of this patent is extended or adjusted under 35 U.S.C. 154(b) by 85 days.

(21) Appl. No.: 16/311,773

(22) PCT Filed: Jul. 19, 2017

(86) PCT No.: PCT/US2017/042694
§ 371 (c)(1),
(2) Date: Dec. 20, 2018

(87) PCT Pub. No.: WO2018/017630
PCT Pub. Date: Jan. 25, 2018

(65) Prior Publication Data

US 2019/0210785 A1 Jul. 11, 2019

Related U.S. Application Data

(60) Provisional application No. 62/364,005, filed on Jul. 19, 2016.

(51) Int. Cl.
*B65D 81/07* (2006.01)
*B65D 5/50* (2006.01)

(52) U.S. Cl.
CPC ..... *B65D 81/07* (2013.01); *B65D 5/5028* (2013.01)

(58) Field of Classification Search
CPC ..... B65D 81/07; B65D 81/075; B65D 81/05; B65D 5/443; B65D 5/422; B65D 5/32;
(Continued)

(56) References Cited

U.S. PATENT DOCUMENTS 4,852,743 A 8/1989 Ridgeway
4,923,065 A 5/1990 Ridgeway
(Continued)

FOREIGN PATENT DOCUMENTS

WO 2014165381 A1 10/2014

OTHER PUBLICATIONS

Written Opinion of the International searching authority in PCT/US2017/042694 dated Jan. 25, 2018.

*Primary Examiner* — Robert Poon
(74) *Attorney, Agent, or Firm* — Jon M. Isaacson

(57) ABSTRACT

A sheet panel (140) is capable of being used with a base panel (110) to form a retention packaging system. The sheet panel (140) includes a first overwrap panel (142), a second overwrap panel (144), a sheet (152) connected to the first overwrap panel (142) and to the second overwrap panel (144), and a detachable portion (148, 150) between the first and second overwrap panels and configured to be detached from the sheet panel. After the detachable portion (148, 150) is detached from the sheet panel (140), the first overwrap panel (142) is configured to be selectively attached to a first tension flap (112) of the base panel at one of a plurality of locations on the first tension flap and the second overwrap panel (144) is configured to be selectively attached to a second tension flap (114) of the base panel at one of a plurality of locations on the second tension flap such that the sheet (152) spans between the first and second tension flaps (112, 114).

21 Claims, 22 Drawing Sheets

(58) Field of Classification Search
CPC ..... B65D 5/5028; B65D 5/5021; B65D 2313/10; B65D 75/305; B65D 75/28
USPC ..... 206/583
See application file for complete search history.

(56) References Cited

U.S. PATENT DOCUMENTS 5,071,009 A 12/1991 Ridgeway
5,287,968 A 2/1994 Ridgeway
5,388,701 A 2/1995 Ridgeway
5,678,695 A * 10/1997 Ridgeway ..... B65D 5/5028 206/305
5,694,744 A 12/1997 Jones
5,893,462 A 4/1999 Ridgeway
6,010,006 A 1/2000 Ridgeway et al.
6,073,761 A 6/2000 Jones
6,148,590 A * 11/2000 Ridgeway ..... B65D 5/5028 206/583
6,148,591 A 11/2000 Ridgeway et al.
6,158,589 A * 12/2000 Smith ..... B65D 5/5028 206/466
6,289,655 B1 9/2001 Ridgeway et al.
6,302,274 B1 10/2001 Ridgeway
6,311,844 B1 11/2001 Ridgeway et al.
2003/0213719 A1 11/2003 Mueller et al.
2004/0108239 A1 6/2004 McDonald et al.
2004/0140243 A1* 7/2004 Roesel ..... B65D 81/07 206/583
2010/0000907 A1* 1/2010 Kashiwabara ..... B65D 5/5028 206/592
2011/0240515 A1* 10/2011 Ridgeway ..... B65D 5/5028 206/583
2013/0233752 A1* 9/2013 Hammerschmidt . B65D 5/5028 206/471
2014/0183097 A1* 7/2014 LeRoy ..... B65D 75/305 206/583
2016/0052691 A1 2/2016 Ridgeway
2017/0247162 A1* 8/2017 Ridgeway ..... B65B 7/20

* cited by examiner

RETENTION PACKAGING ASSEMBLY WITH SEPARATE COMPONENTS

BACKGROUND

The present disclosure is in the technical field of protective packaging. More particularly, the present disclosure is directed to retention packaging.

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "retention packaging." In typical retention packaging, a product is retained between a sheet and a rigid backing frame, which is sometimes the frame to which the sheet is attached. Another type of packaging system is known as suspension packaging. In typical suspension packaging, the packaged product is suspended between two sheets each attached to opposing frames sized to fit within a corresponding box. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, and in U.S. patent application Ser. No. 14/782,208, each of which is incorporated herein in its entirety by reference.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one embodiment, a retention packaging system includes a base panel and a sheet panel. The base panel includes first and second tension flaps foldably connected to a base portion, respectively, by first and second fold lines between the base portion and the first and second tension flaps. The sheet panel includes a sheet connected to a first overwrap panel and a second overwrap panel, where the sheet panel further includes at least one detachable portion between the first and second overwrap panels, where the first overwrap panel includes a first attachment zone, and where the second overwrap panel includes a second attachment zone. After the at least one detachable portion is detached from the sheet panel, the first overwrap panel is configured to be selectively attached to the first tension flap at one of a plurality of locations on the first tension flap and the second overwrap panel is configured to be selectively attached to the second tension flap at one of a plurality of locations on the second tension flap such that the sheet spans between the first and second tension flaps. The first and second tension flaps are configured to be in a first position when the first and second overwrap panels are attached to the first and second tension flaps, respectively, to permit placement of an object between the sheet and the base portion. The first and second tension flaps are configured to be rotated about the first and second fold lines, respectively, from the first position to a second position below the base portion, and the object is biased toward the base portion by the sheet when the first and second tension flaps are in the second position.

In one example, when the first and second tension flaps are in the second position, the first and second tension flaps are against a side of the base portion opposite of a side of the base portion toward which the object is biased by the sheet. In another example, the base panel further includes first and second support flaps foldably connected to the base portion, respectively, by third and fourth fold lines between the base portion and the first and second support flaps. In another example, when the first and second tension flaps are in the second position, the first support flap is configured to be rotated about the third fold line toward the object and the second support flap is configured to be rotated about the fourth fold line toward the object.

In another embodiment, a sheet panel is usable with a base panel to form a retention packaging system, where the base panel includes a first tension flap foldably connected to a base portion by a first fold line and a second tension flap foldably connected to the base portion by a second fold line. The sheet panel includes a first overwrap panel that includes a first attachment zone, a second overwrap panel that includes a second attachment zone, a sheet connected to the first overwrap panel and to the second overwrap panel, and at least one detachable portion between the first and second overwrap panels and configured to be detached from the sheet panel. After the at least one detachable portion is detached from the sheet panel, the first overwrap panel is configured to be selectively attached to the first tension flap at one of a plurality of locations on the first tension flap and the second overwrap panel is configured to be selectively attached to the second tension flap at one of a plurality of locations on the second tension flap such that the sheet spans between the first and second tension flaps.

In one example, the first and second tension flaps are configured to be in a first position when the first and second overwrap panels are attached to the first and second tension flaps, respectively, to permit placement of an object between the sheet and the base portion, the first and second tension flaps are configured to be rotated about a the first and second fold lines, respectively, from the first position to a second position below the base portion, and the object is biased toward the base portion by the sheet when the first and second tension flaps are in the second position. In another example, the at least one detachable portion of the sheet panel includes a base reinforcing portion. In another example, the base reinforcing portion is configured to be placed between the object and the base portion of the base panel before the first and second tension flaps are rotated from the first position to the second position. In another example, the sheet panel further includes a central portion located between the first tension flap and the second tension flap, where the central portion is attached to the sheet. In another example, the at least one detachable portion includes a first detachable portion located between the first tension flap and the central portion before the first detachable portion is detached from the sheet panel, and a second detachable portion located between the second tension flap and the central portion before the second detachable portion is detached from the sheet panel. In another example, the central portion is attached to the sheet such that, when the first and second tension flaps are in the second position, the object is located between the base portion of the base panel and the central portion of the sheet panel.

In another example, the at least one detachable portion further includes a first detachable portion located between the first overwrap panel and the base reinforcing portion before the first detachable portion and the base reinforcing portion are detached from the sheet panel, and a second detachable portion located between the second overwrap panel and the base reinforcing portion before the second detachable portion and the base reinforcing portion are detached from the sheet panel. In another example, the first overwrap panel includes a first plurality of fold lines and the second overwrap panel includes a second plurality of fold lines. In another example, one of the first plurality of fold lines and one of the second plurality of fold lines are selectively aligned with ends of the first and second tension flaps, respectively, based on one or more of a desired tension of the sheet or a size of an object between the sheet and the base portion. In another example, the first attachment zone is on a first side of the first overwrap panel, the second attachment zone is attached to a first side of the second overwrap panel, and the sheet is attached to the first side of the first overwrap panel and to the first side of the second overwrap panel. In another example, the first attachment zone is on a first side of the first overwrap panel, the second attachment zone is attached to a first side of the second overwrap panel, and the sheet is attached to a second side of the first overwrap panel and to a second side of the second overwrap panel.

In another embodiment, a method of packaging an object is using a retention packaging system. The retention packaging system includes a base panel and a sheet panel, the base panel including first and second tension flaps foldably connected to a base portion, and the sheet panel including a first overwrap panel, a second overwrap panel, at least one detachable portion between the first and second overwrap panels, and a sheet connected to the first overwrap panel and the second overwrap panel. The method includes detaching the at least one detachable portion from the sheet panel and attaching the sheet panel to the base panel such that the sheet spans between the first and second tension flaps and the first and second tension flaps are in a first position. Attaching the sheet panel to the base panel includes attaching the first overwrap panel to the first tension flap at one of a plurality of locations on the first tension flap and attaching the second overwrap panel to the second tension flap at one of a plurality of locations on the second tension flap. The method further includes placing the object between the sheet and the base portion while the first and second tension flaps are in the first position and rotating the first and second tension flaps about first and second fold lines, respectively, from the first position to a second position below the base portion. The object is biased toward the base portion by the sheet when the first and second tension flaps are in the second position.

In one example, the method further includes selecting the one of the plurality of locations on the first tension flap and the one of the plurality of locations on the second tension flap based on at least one of a desired tension of the sheet or a size of the object. In another example, the plurality of locations on the first tension flap correspond to a plurality of fold lines on the first overwrap panel. In another example, attaching the first overwrap panel to the first tension flap at the one of the plurality of locations on the first tension flap includes aligning a corresponding one of the plurality of fold lines on the first overwrap panel to an end of the first tension flap. In another example, the method further includes obtaining the sheet panel from a first source and obtaining the base panel from a second source, where the first source is different than the second source.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The present disclosure describes embodiments of retention packaging systems. While existing retention structures provide a level of protection for the packaged object, there is room for improvement. For example, existing retention structures are designed for a particular size and/or shape of an object. These existing retention structures are not capable of being modified to address a different size or shape of object. In addition, existing retention structures are designed and manufactured as a complete system and pieces of the system cannot be obtained separately, such as from a local source.

Embodiments of retention packaging systems described herein include multiple pieces, such as a base panel and a sheet panel, that are provided separately before being attached to form a retention packaging system. The sheet panel is attachable to the base panel in a number of different locations. This allows the sheet panel to be arranged with respect to the base panel to accommodate a number of different sizes and/or shapes of objects. In addition, the base panel and the sheet panel are capable of being supplied to users separately. Thus, the user may obtain the base panel separately from the sheet panel. This may save money, such as in the case where the user obtains the base portion locally and the sheet panel from a particular manufacturer instead of obtaining the base panel and the sheet panel from the same particular manufacturer.

Figure 1A:
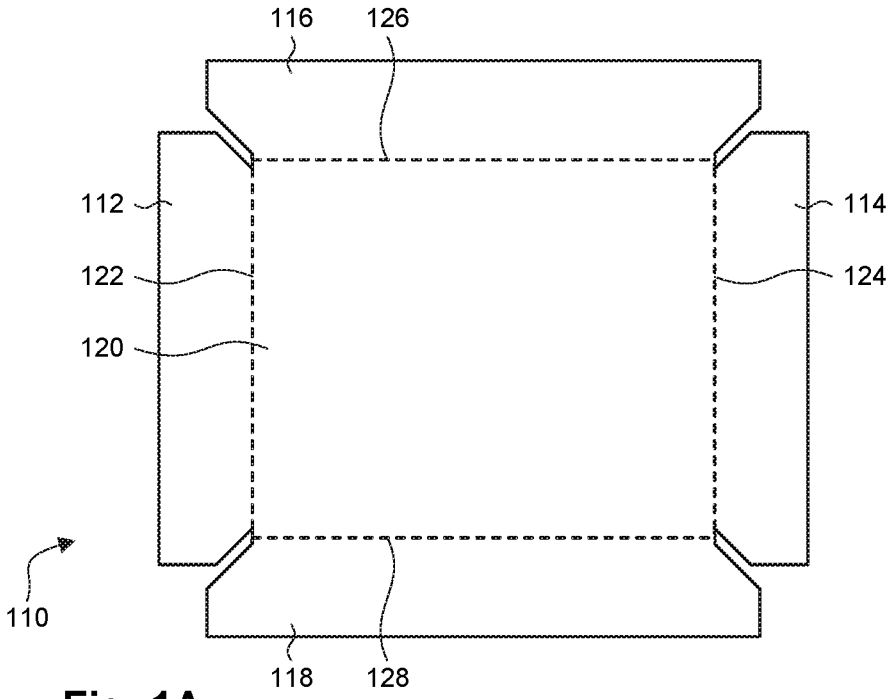
FIG. 1A depicts a top view of an embodiment of a base panel that is usable as part of a retention packaging system, in accordance with the embodiments disclosed herein.

Depicted in FIG. 1A is a top view of an embodiment of a base panel 110 that is usable as part of a retention packaging system (e.g., retention packaging system 100 described below). In some embodiments, the base panel 110 or any portion thereof, comprises a substantially rigid, lightweight, foldable material. In some examples, base panel 110, or any of the portions of base panel 110 described herein, are formed of one or more of any of the following materials: cellulosic-based materials (e.g., cardboard, corrugated cardboard, paperboard), plastic, and compressed foam. In one example, base panel 110 may comprise corrugated cardboard, such as any of single-wall B-flute, C-flute, and/or E-flute corrugated cardboard, B/C double-wall corrugated cardboard, E/B double-wall corrugated cardboard, or any combination thereof. In some embodiments, the base panel 110 has a predetermined average thickness. In some examples, the average thickness of the base panel 110, for example, at most about, and/or at least about, any of the following thicknesses: 0.03, 0.06, 0.12, 0.18, 0.25, 0.3, 0.4, and 0.5 inches.

The base panel 110 is configured to be folded to form a portion of a retention packaging system, example embodiments of which are described below with respect to FIGS. 2A to 2J and FIGS. 3A to 3J. In the embodiment depicted in FIG. 1A, the base panel 110 includes a first tension flap 112, a second tension flap 114, a first support flap 116, a second support flap 118, and a base portion 120. A first fold line 122 is located between the base portion 120 and the first tension flap 112, a second fold line 124 is located between the base portion 120 and the second tension flap 114, a third fold line 126 is located between the base portion 120 and the first support flap 116, and a fourth fold line 128 is located between the base portion 120 and the second support flap 118. A "fold line," as used herein, represents a line along which a panel, frame, or other material has been creased, crimped, embossed, perforated, scored, or otherwise weakened so as to enhance the foldability of the panel, frame, or other material along the fold line. The first and second tension flaps 112 and 114 are rotatably connected to the base portion 120 by the first and second fold lines 122 and 124, respectively. The first and second support flaps 116 and 118 are rotatably connected to the base portion 120 by the third and fourth fold lines 126 and 128, respectively.

The fold lines depicted in FIG. 1A are dashed lines to represent creased fold lines. For example, the first and second tension flaps 112 and 114 and the first and second support flaps 116 and 118 are rotatably connected to the base portion 120 by creased fold lines (e.g., the first, second, third, and fourth fold lines 122, 124, 126, and 128). In other embodiments depicted in the figures, fold lines are depicted with long-short-long dashed lines to represent perforated fold lines (e.g., perforated line 166 depicted in FIGS. 1B and 1C). While the fold lines depicted in the figures may represent particular forms of fold lines, the depicted fold lines could be replaced with any other form of fold lines.

Figure 1B:
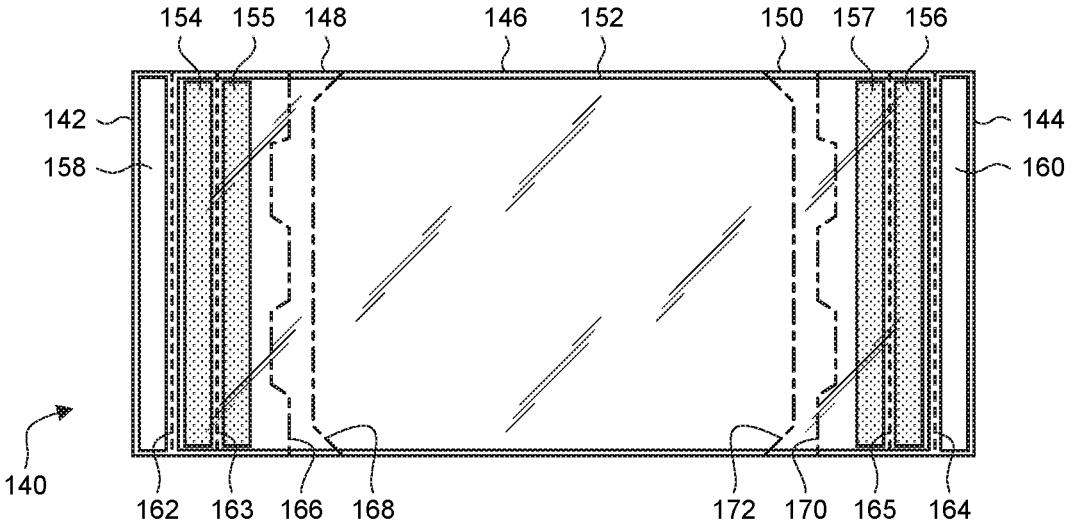
FIGS. 1B and 1C depict top and bottom views, respectively, of an embodiment of a sheet panel that is usable with the base panel depicted in FIG. 1A as part of a retention packaging system, in accordance with the embodiments disclosed herein.
Figure 1C:
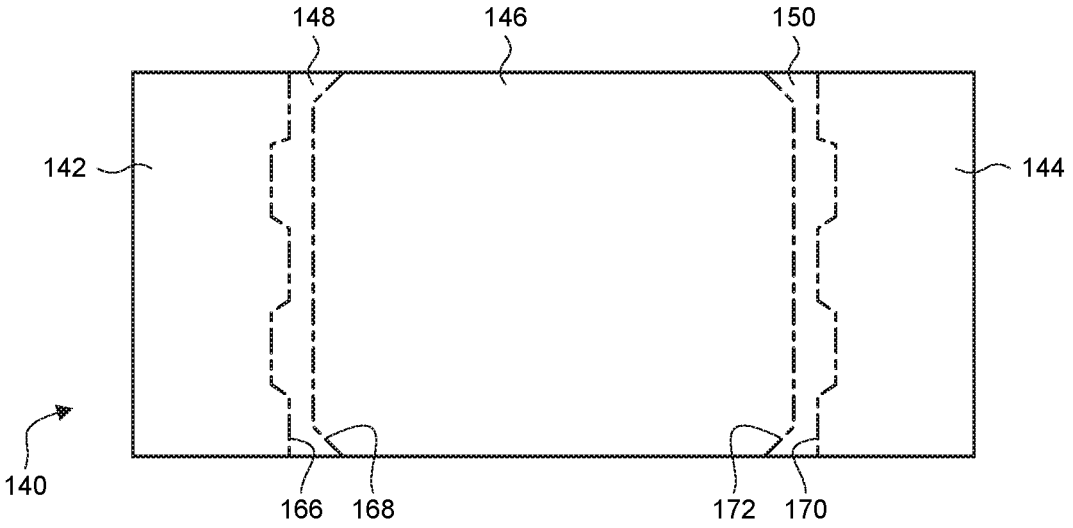

Depicted in FIGS. 1B and 1C are top and bottom views, respectively, of an embodiment of a sheet panel 140 that is usable as part of a retention packaging system (e.g., retention packaging system 100 described below). In some embodiments, the sheet panel 140 or any portion thereof, comprises a substantially rigid, lightweight, foldable material, including one or more of the materials described above with respect to base panel 110. The sheet panel 140 includes a first overwrap panel 142 and a second overwrap panel 144. In some embodiments, the sheet panel 140 includes at least one detachable portion between the first overwrap panel 142 and the second overwrap panel 144. In the depicted embodiment, the at least one detachable portion between the first overwrap panel 142 and the second overwrap panel 144 includes a base reinforcing portion 146, a first detachable portion 148, and a second detachable portion 150.

The sheet panel 140 also includes a sheet 152. In the depicted embodiment, the sheet 152 extends between and is fixedly coupled to the first overwrap panel 142 and the second overwrap panel 144. In the depicted embodiment, the sheet 152 is attached to the first overwrap panel 142 by attachment zones 154 and an attachment zone 155, and the sheet 152 is attached to the second overwrap panel 144 by an attachment zone 156 and an attachment zone 157. In the depicted embodiment, the sheet 152 is attached to the first overwrap panel 142 by two distinct attachment zones 154 and 155, and the sheet 152 is attached to the second overwrap panel 144 by two distinct attachment zones 156 and 157. However, in other embodiments, the sheet 152 is attached to each of the first overwrap panel 142 and the second overwrap panel 144 using either a single attachment zone or any number of distinct attachment zones.

In some examples, the sheet 152 is attached to the first and second overwrap panels 142 and 144 by adhering with adhesive (e.g., when the attachment zones 154, 155, 156, and 157 include adhesive). However, the attachment zones 154, 155, 156, and 157 may be formed to attach the sheet 152 to the first and second overwrap panels 142 and 144 by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), tab/slot engagement (see, e.g., U.S. Pat. No. 6,073,761 to Jones, which is incorporated herein in its entirety by reference), anchoring, retaining and/or securing (see, e.g., U.S. Pat. No. 7,743,924 to McDonald et al., which is incorporated herein in its entirety by reference, and which discloses a sleeve having pockets or pouches for receiving a flap as shown in FIGS. 24-25 and related discussion therein). The sheets of any embodiments described herein may be attached by one or more of any of the attachment ways described herein. Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

The sheet 152, and any of the sheets of the various embodiments described herein, may comprise any of the materials, compositions, and polymers set forth herein with respect to sheets, and may have any thickness, properties, treatments, additives, and other characteristics (e.g., flexibility, elasticity, optics, strength, elastic recovery, transparency, load tear resistance, puncture resistance) as set forth herein with respect to sheets.

In some embodiments, the sheet 152 has a composition and thickness providing acceptable performance properties (e.g., flexibility, elasticity, optics, strength) for the given packaging application of expected use. In some examples, the sheet 152 has a thickness of at most any of the following: 10 mils, 6 mils, 5 mils, 4 mils, 3 mils, 2 mils, 1.5 mils, and 1 mil. (A "mil" is equal to 0.001 inch.) In some examples, the sheet 152 has a thickness of at least any of the following: 0.5 mils, 1 mil, 1.5 mils, 2 mils, and 3 mils.

In some embodiments, the sheet 152 has an elastic recovery in either or both of the transverse and longitudinal directions of at least any of the following values: 60%, 65%, 70%, 75%, 80%, and 85%, measured according to ASTM D5459 at 100% strain, 30 seconds relaxation time, and 60 second recovery time.

In some embodiments, the sheet 152 has a maximum load tear resistance in either or both of the transverse and longitudinal directions of at least any of the following values: 400, 450, 500, 550, and 600 grams force, measured according to ASTM D1004.

In some embodiments, the sheet 152 has a slow puncture maximum load of at least any of the following values: 4, 4.5, 5, 5.5, 6, 6.5, and 7 pounds force, measured according to ASTM F1306 using a crosshead speed of 5 inches per minute.

In some embodiments, the sheet 152 has a Young's modulus sufficient to withstand the expected handling and use conditions, yet may provide a "soft" feel that may be desirable for a packaging application. The sheet may have a Young's modulus of at least any of the following values: 2,000; 2,500; 3,000; 3,500; and 4,000 pounds/square inch. The sheet may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

In some embodiments, the sheet 152 is transparent so that a packaged article is visible through the sheet. As used herein, "transparent" means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least any of the following values: 65%, 70%, 75%, 80%, 85%, and 90%, measured in accordance with ASTM D1746.

In some embodiments, the sheet 152 has a heat-shrink attribute. In some examples, the sheet 152 has any of a free shrink in at least one direction (i.e., machine or transverse directions), in each of at least two directions (i.e., machine and transverse directions), measured at any of 160° F. and 180° F. of at least any of the following: 7%, 10%, 15%, 20%, 25%, 30%, 40%, 50%, 55%, 60% and 65%. In other embodiments, the sheet 152 is non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

In some embodiments, the sheet 152 includes one or more fabrics. For example, in some embodiments, the sheet 152 includes one or more of the following: wovens, knits, nonwovens, and openwork meshes (e.g., netting), spandex, including Lycra® brand spandex, and elastic fabrics.

In some embodiments, the sheet 152 includes one or more polymers. In some examples, the sheet 152 includes one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). In some embodiments, the sheet 152 includes thermoplastic polyolefin elastomers (TPOs), which are two-component elastomer systems comprising an elastomer (such as EPDM) finely dispersed in a thermoplastic polyolefin (such as polypropylene or polyethylene). As used in this application, "copolymer" means a polymer derived from two or more types of monomers, and includes terpolymers, etc.

In some embodiments, the sheet 152 includes polyolefin (e.g., polyethylene), polyvinyl chloride, and/or polyurethane. In some examples, such embodiments of the sheet 152 have a thickness of from 2 to 4 mils. Such embodiments of the sheet 152 may be useful for lightweight applications. In some examples, the sheet 152 including polyurethane may provide desirable elastomeric, puncture resistance, temperature resistance, and tackiness characteristics.

In some embodiments, the sheet 152 includes effective amounts of one or more of tackifiers, antiblocking agents, and slip agents—or may be essentially free of any of these components. Tackifiers, antiblocking agents, and slip agents, and their effective amounts, are known to those of ordinary skill in the art.

In some embodiments, the sheet 152 is manufactured by thermoplastic film-forming processes known in the art (e.g., tubular or blown-film extrusion, coextrusion, extrusion coating, flat or cast film extrusion). In some embodiments, a combination of these processes is also employed to manufacture the sheet 152.

In some embodiments, at least one side of the sheet 152 is corona and/or plasma treated to change the surface energy of the sheet 152. In one example, the change in surface energy increases the ability of the sheet 152 to adhere to a panel or frame.

Films that may be useful as sheets (e.g., sheet 152) are described in U.S. Pat. No. 6,913,147, issued Jul. 5, 2005, and entitled "Packaging Structure Having a Frame and Film," which is incorporated herein in its entirety by reference.

By using types of machinery well known to those of skill in the field, the base panel 110 and/or the sheet panel 140 may be cut to the desired shapes and provided with fold lines or lines of detachability, using the known types of machinery, for example, to slit, crease, crimp, emboss, perforate, scored, or otherwise weaken the panel in desired regions. In some embodiments, attachment zones are applied to the sheet panel 140 in selected areas, for example, the attachment zones 154 and 156 shown in FIG. 1B. In some embodiments, the sheet 152 is attached to the first and second overwrap panels 142 and 144 by laminating or adhering the sheet 152 with adhesive to the first and second overwrap panels 142 and 144. In some embodiments, the material of the sheet 152 is provided in roll form or unrolled form, and then cut to the desired length and width either before or after attachment to the first and second overwrap panels 142 and 144.

The sheet panel 140 further includes a first liner 158 on the first overwrap panel 142 and a second liner 160 on the second overwrap panel 144. The first liner 158 covers a first attachment zone (not visible in FIGS. 1B and 1C) and the second liner 160 covers a second attachment zone (not visible in FIGS. 1B and 1C). As described in some example below, the first attachment zone is configured to attach the first overwrap panel 142 of the sheet panel 140 to the first tension flap 112 of the base panel 110 and the second attachment zone is configured to attach the second overwrap panel 144 of the sheet panel 140 to the second tension flap 114 of the base panel 110.

In some embodiments, the first overwrap panel 142 includes fold lines 162 and 163, and the second overwrap panel 144 includes fold lines 164 and 165. In some embodiments, the first and second overwrap panels 142 and 144 are configured to be folded about one or more of the fold lines 162, 163, 164, and 165. In some embodiments, the fold lines 162 and 164 are usable to align the first and second overwrap panels 142 and 144 with respect to the first and second tension flaps 112 and 114 when attaching the first and second overwrap panels 142 and 144 to the first and second tension flaps 112 and 114.

In the depicted embodiment, the sheet panel 140 includes a perforation line 166 between the first overwrap panel 142 and the first detachable portion 148, a perforation line 168 between the first detachable portion 148 and the base reinforcing portion 146, a perforation line 170 between the second overwrap panel 144 and the second detachable portion 150, and a perforation line 172 between the second detachable portion 150 and the base reinforcing portion 146. In some embodiments, the perforation lines 166, 168, 170, and 172 are formed such that the perforation lines 166, 168, 170, and 172 are capable of being broken by hand (i.e., broken without the use of a tool, such as a box cutter). In this way, the base reinforcing portion 146, the first detachable portion 148, and the second detachable portion 150 are able to be detached from the first and second overwrap panels 142 and 144 by hand.

In some embodiments, the base panel 110 and the sheet panel 140 are provided in a lay-flat configuration, such as in the configuration shown in FIGS. 1A to 1C. For example, the base panel 110 may be provided with the first and second tension flaps 112 and 114 and the first and second support flaps 116 and 118 in an unfolded position, with each being generally coplanar with the base portion 120. Further, the perforation lines 166, 168, 170, and 172 are not yet broken. Such configurations may facilitate the provision of multiple base panels and multiple sheet panels in a convenient stacked or bundled arrangement (not illustrated). In some embodiments, the base panels and the sheet panels are supplied separately before being used to form a retention packaging system.

Figure 2B:
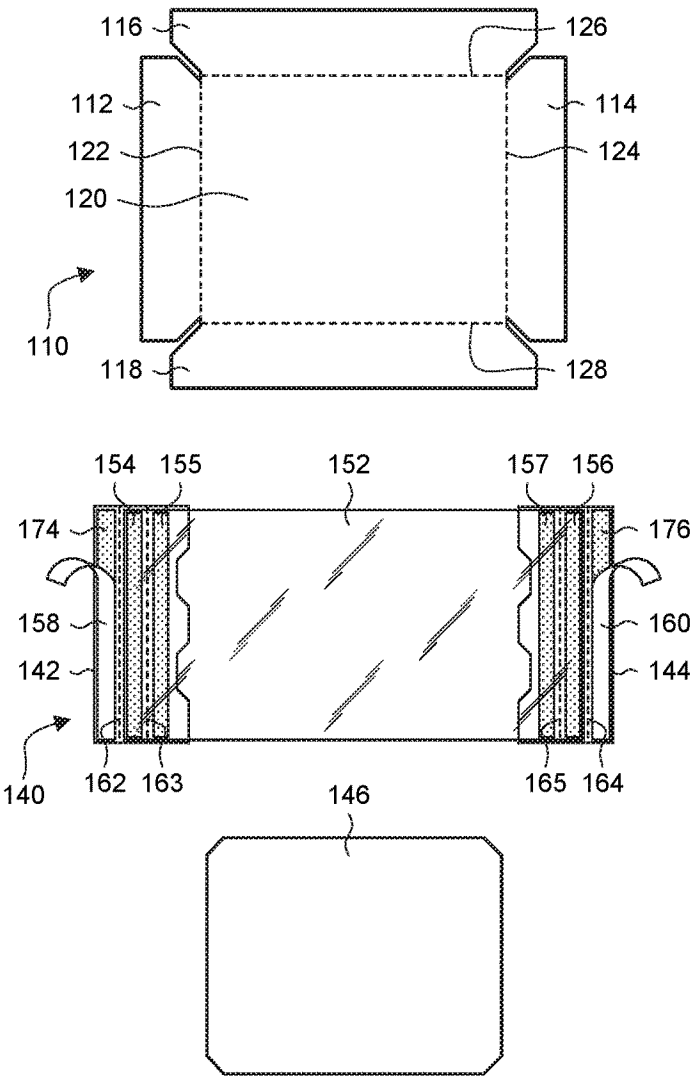
FIGS. 2A to 2J depict an embodiment of forming the base panel depicted in FIG. 1A and the sheet panel depicted in FIGS. 1B and 1C into a retention packaging system, in accordance with the embodiments disclosed herein.
Figure 2A:
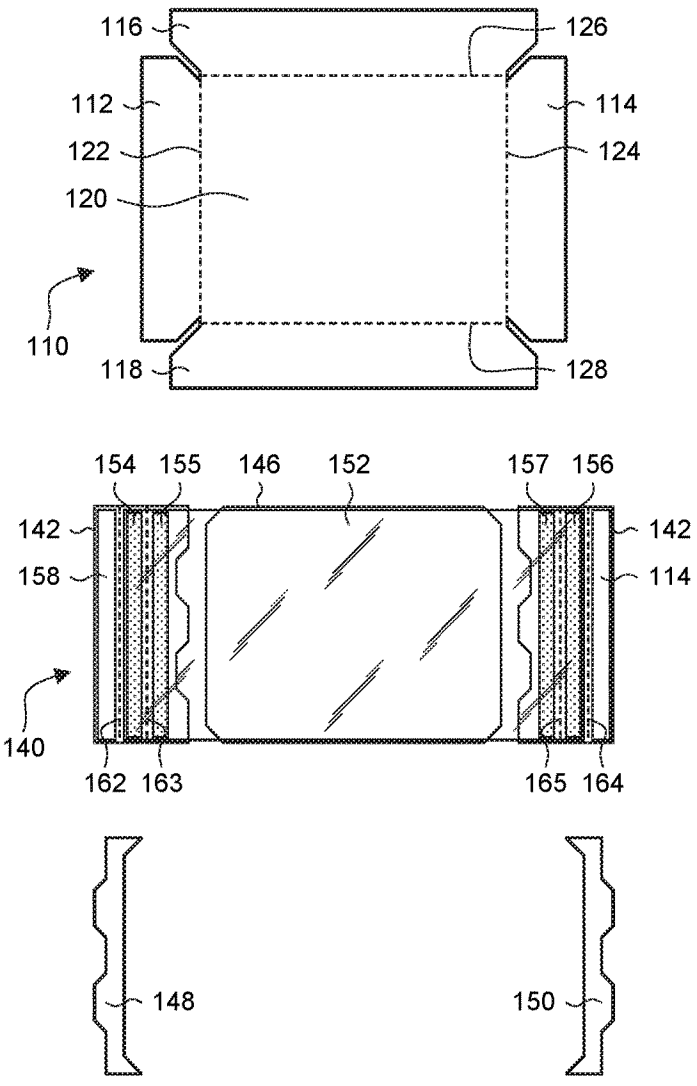
Figure 2E:
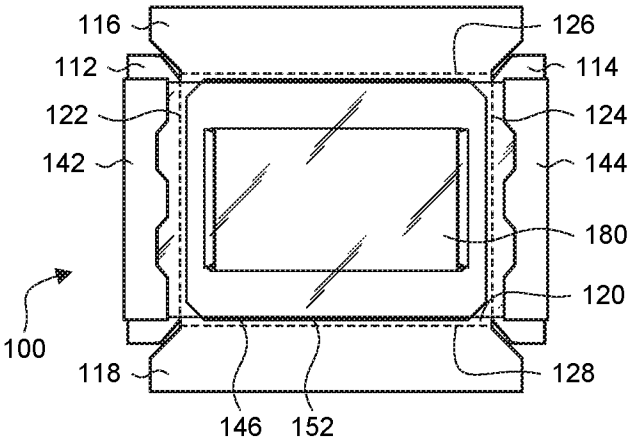
Figure 2F:
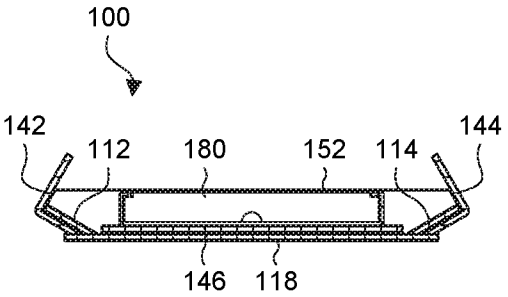
Figure 2C:
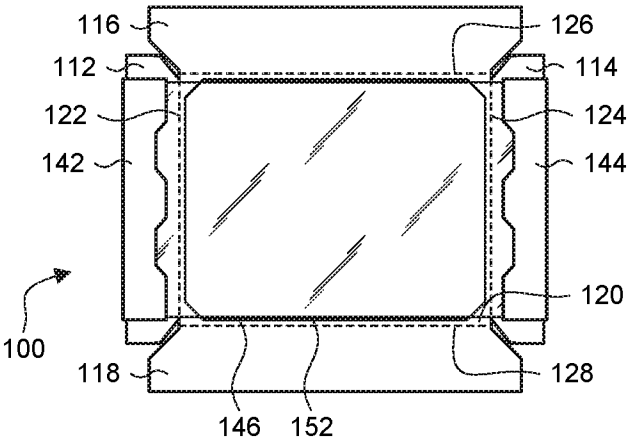
Figure 2D:
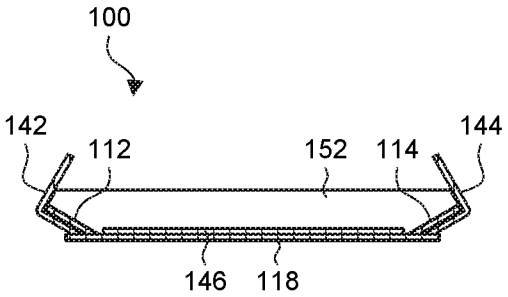
Figure 2I:
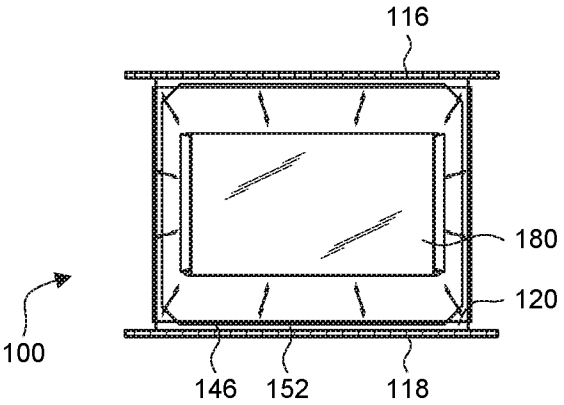
Figure 2J:
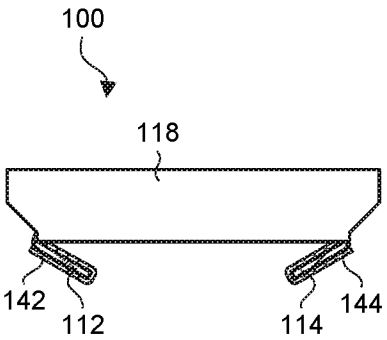
Figure 2G:
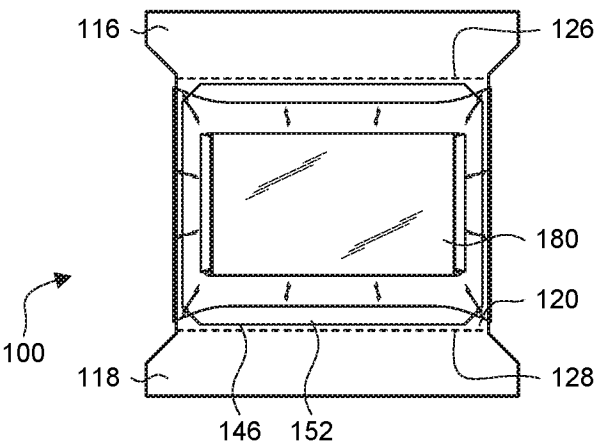
Figure 2H:
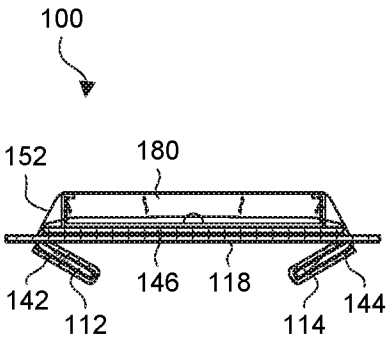

As noted above, the base panel 110 and the sheet panel 140 are usable as part of a retention packaging system. One embodiment of forming the base panel 110 and the sheet panel 140 in a retention packaging system 100 is depicted in FIGS. 2A to 2J. More specifically, FIGS. 2A and 2B depict top views of embodiments of a first instance and a second instance, respectively, of forming the retention packaging system 100; FIGS. 2C and 2D depict top and front views, respectively, of a third instance of forming the retention packaging system 100; FIGS. 2E and 2F depict top and front views, respectively, of a fourth instance of forming the retention packaging system 100; FIGS. 2G and 2H depict top and front views, respectively, of a fifth instance of forming the retention packaging system 100; and FIGS. 21 and 2J depict top and front views, respectively, of a sixth instance of forming the retention packaging system 100.

In the first instance depicted in FIG. 2A, the first detachable portion 148 has been removed from the first overwrap panel 142 and the base reinforcing portion 146. In addition, the second detachable portion 150 has been removed from the second overwrap panel 144 and the base reinforcing portion 146. In some embodiments, the first detachable portion 148 is removed from the first overwrap panel 142 and the base reinforcing portion 146 by breaking the perforated lines 166 and 168. In some embodiments, the second detachable portion 150 is removed from the second overwrap panel 144 and the base reinforcing portion 146 by breaking the perforated lines 170 and 172. In some embodiments, the first and second overwrap panels 142 and 144 are discarded (e.g., recycled) after the first instance depicted in FIG. 2A.

In the second instance depicted in FIG. 2B, the first and second detachable portions 148 and 150 have been discarded. In addition, the base reinforcing portion 146 has been withdrawn from the first and second overwrap panels 142 and 144 and the sheet 152. In some embodiments, the sheet 152 is made from a flexible material such that, in the instances shown in FIGS. 2A and 2B, the first and second overwrap panels 142 and 144 are not in a fixed position with respect to each other. In some embodiments, the first liner 158 is removed from a first attachment zone 174 and the second liner 160 is removed from a second attachment zone 176. The first attachment zone 174 is configured to attach the first overwrap panel 142 of the sheet panel 140 to the first tension flap 112 of the base panel 110. The second attachment zone 176 is configured to attach the second overwrap panel 144 of the sheet panel 140 to the second tension flap 114 of the base panel 110.

In the third instance depicted in FIGS. 2C and 2D, the base reinforcing portion 146 is placed on the base portion 120 of the base panel 110. Adding the base reinforcing portion 146 to the base portion 120 adds to the strength and rigidity of the base portion 120 such that the base portion 120 is less likely to be deformed during formation and use of the retention packaging system 100. In some embodiments, the use of the base reinforcing portion 146 in addition to the base portion 120 allows the base portion 120 to be thinner than otherwise would be required to prevent deformation of the base portion 120 during formation and use of the retention packaging system 100.

In addition, as shown in FIGS. 2C and 2D, the first and second overwrap panels 142 and 144 of the sheet panel 140 have been attached to the first and second tension flaps 112 and 114, respectively. In some embodiments, the location of the attachment of the first overwrap panel 142 on the first tension flap 112 and the location of the attachment of the second overwrap panel 144 on the second tension flap 114 are selected based on one or more of a size of an object or a desired tension in the sheet 152. In the embodiment shown in FIGS. 2C and 2D, the first overwrap panel 142 has been folded about the fold line 163 between the attachment zones 154 and 155, and the second overwrap panel 144 has been folded about the fold lines 165 between the attachment zones 156 and 157. As seen in the embodiment depicted in FIG. 2D, the location of the attachment of the first and second overwrap panels 142 and 144 on the first and second tension flaps 112 and 114 causes the sheet 152 to be taut. It also causes the first and second tension flaps 112 and 114 to be rotated up at an angle about the first and second fold lines 122 and 124, respectively.

In the fourth instance depicted in FIGS. 2E and 2F, an object 180 is placed between the sheet 152 and the base portion 120. In some embodiments, including the embodiment depicted in FIGS. 2E and 2F, the object 180 is placed between the base reinforcing portion 146 and the sheet 152. In the depicted embodiment, the object 180 is a box; however, the object 180 can be any type or form of an object. As noted above, in some embodiments, the location of the attachment of the first overwrap panel 142 on the first tension flap 112 and the location of the attachment of the second overwrap panel 144 on the second tension flap 114 is selected based on a size of the object 180 (e.g., the height of the object 180). In one embodiment, the fold line 163 is aligned with the left end of the first tension flap 112 when the first overwrap panel 142 is attached to the first tension flap 112 and the fold line 165 is aligned with the right end of the second tension flap 114 when the second overwrap panel 144 is attached to the second tension flap 114. In this embodiment, the alignments of the fold line 163 with the left end of the first tension flap 112 and the fold line 165 with the right end of the second tension flap 114 are selected based on a size and/or height of the object 180.

In the fifth instance depicted in FIGS. 2G and 2H, the first and second tension flaps 112 and 114 have been rotated down about the first and second fold lines 122 and 124, respectively, until the first and second tension flaps 112 and 114 are below the base portion 120. Because the first and second overwrap panels 142 and 144 are attached to the first and second tension flaps 112 and 114, the first and second overwrap panels 142 and 144 are also located below the base portion 120. The sheet 152 has been pulled tight over the object 180, such that the object 180 is biased toward the base reinforcing portion 146 and the base portion 120. In this way, the object 180 is retained by the retention packaging system 100.

In the particular embodiment shown in FIGS. 2G and 2H, the first and second tension flaps 112 and 114 are not folded back until the first and second tension flaps 112 and 114 and/or the first and second overwrap panels 142 and 144 are flush against the bottom of the base portion 120. The properties of the sheet 152 and/or the location of the first and second overwrap panels 142 and 144 on the first and second tension flaps 112 and 114. The position of the first and second tension flaps 112 and 114 and the first and second overwrap panels 142 and 144 may be helpful, depending on the size of a container into which the retention packaging system 100 will be placed or a desired shock absorbance of the bottom of the retention packaging system 100.

In the sixth instance depicted in FIGS. 21 and 2J, the first and second support flaps 116 and 118 have been folded toward the object 180 about the fold lines 126 and 128, respectively. Rotating the first and second support flaps 116 and 118 in this manner provides structural stability to the retention packaging system 100 and provides protection to the sides of the object 180. In this position, the retention packaging system 100, with the object 180 retained inside, is capable of being placed into a container.

Figure 2M:
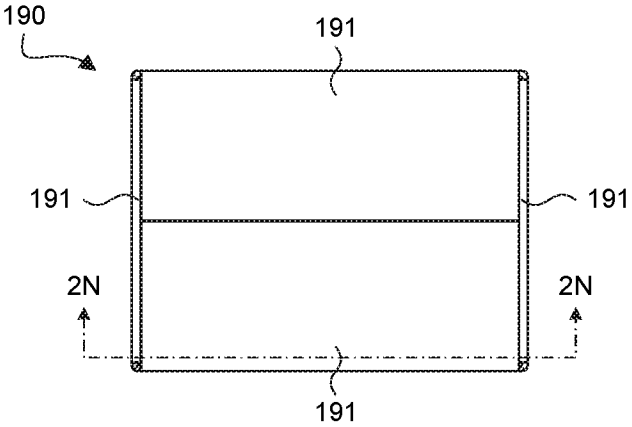
FIGS. 2K to 2N depict an embodiment of placing the retention packaging system depicted in FIGS. 2I and 2J into a container, in accordance with the embodiments disclosed herein.
Figure 2N:
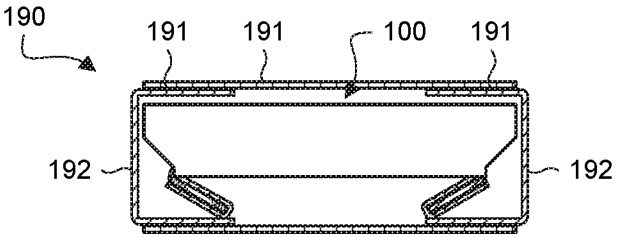
Figure 2K:
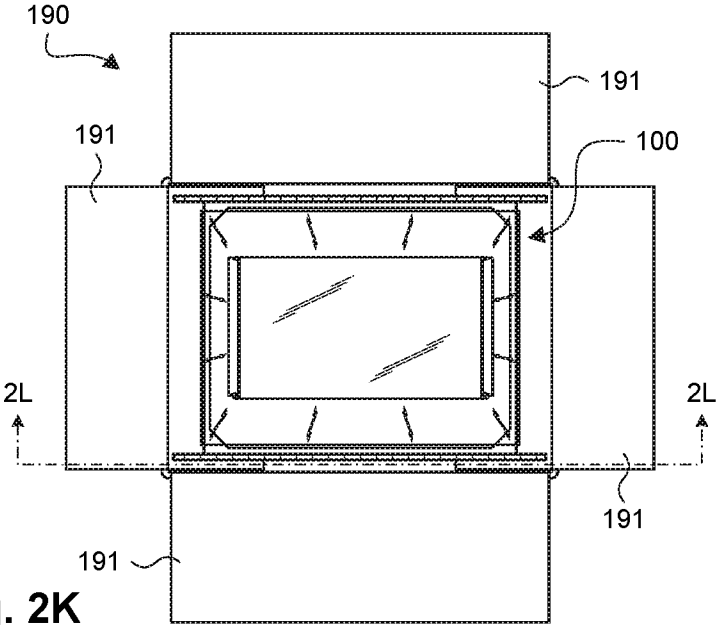
Figure 2L:
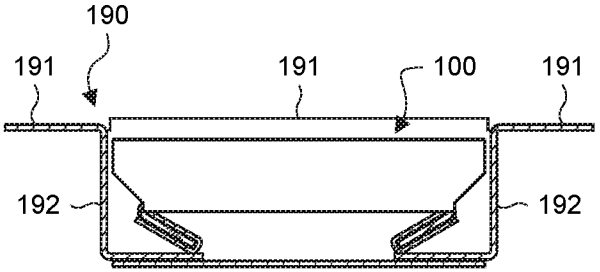

One example of a inserting the retention packaging system 100 into a container 190 is depicted in FIGS. 2K to 2N. More specifically, the FIGS. 2K and 2L depict top and side sectional views, respectively, of the retention packaging system 100 in the container 190 when the container 190 is in an open position. FIGS. 2M and 2N depict top and side sectional views, respectively, of the retention packaging system 100 in the container 190 when the container 190 is in a closed position. The container includes top flaps 191 and sides 192. In the open position, the top flaps 191 are in a position that allows the retention packaging system 100 to be inserted into the container 190. In the closed position, the top flaps 191 are in a position that prevents the retention packaging system 100 from being removed from the container 190.

In one example, as the retention packaging system 100 is inserted into the container 190 to the position shown in FIGS. 2K and 2L, the first and second support flaps 116 and 118 act as a guide to position the retention packaging system 100 with respect to the sides 192 of the container 190. In some embodiments, the container 190 has dimensions (e.g., a width, a length, and a height) selected based on the dimensions of the retention packaging system 100 shown in the sixth instance in FIGS. 2I and 2J. In one example, the container 190 has inner dimensions (e.g., height, width, and depth) that are based on the outer dimensions of the retention packaging system 100 in the condition shown in the sixth instance. After the retention packaging system 100 is inserted into the container 190 to the position shown in FIGS. 2K and 2L, the top flaps 191 of the container 190 are capable of being closed to the position shown in FIGS. 2M and 2N.

Figure 3B:
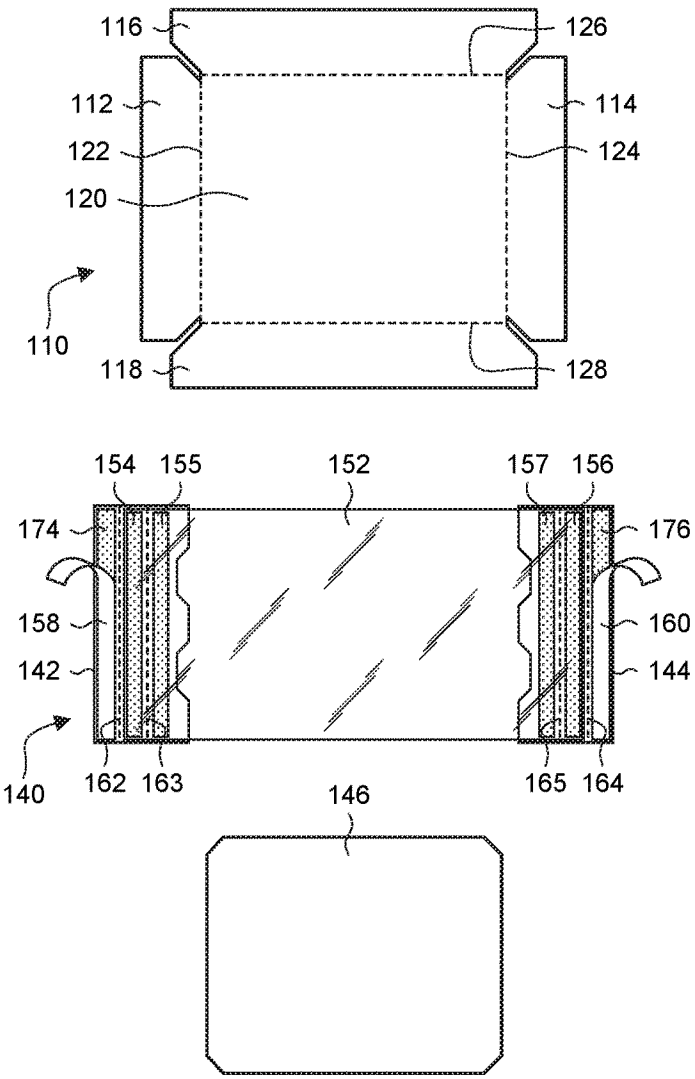
FIGS. 3A to 3J depict another embodiment of forming the base panel depicted in FIG. 1A and the sheet panel depicted in FIGS. 1B and 1C into a retention packaging system, in accordance with the embodiments disclosed herein.
Figure 3A:
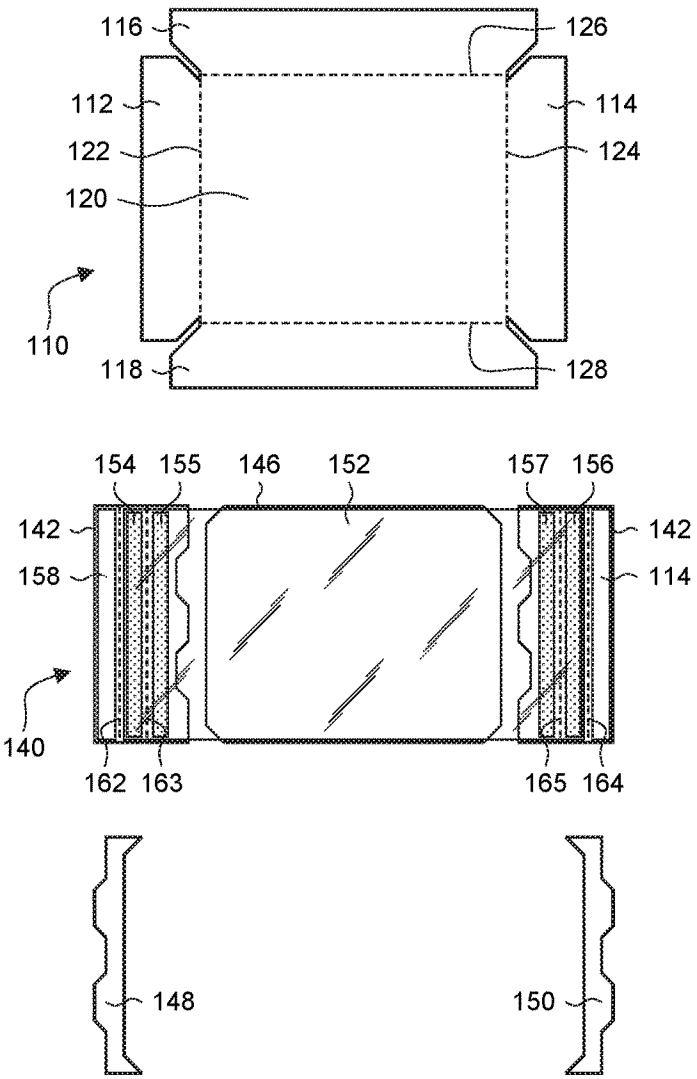
Figure 3E:
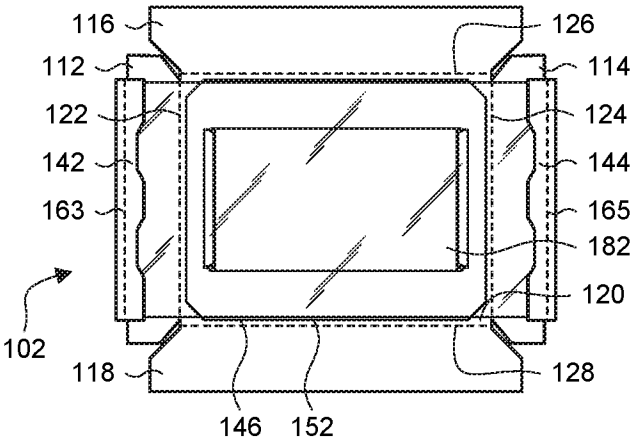
Figure 3F:
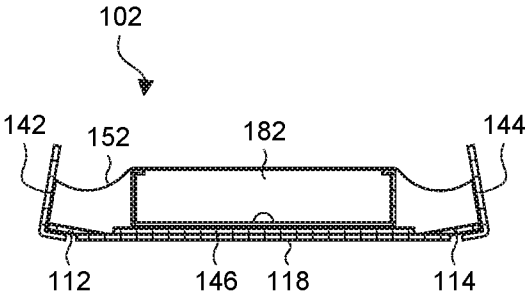
Figure 3C:
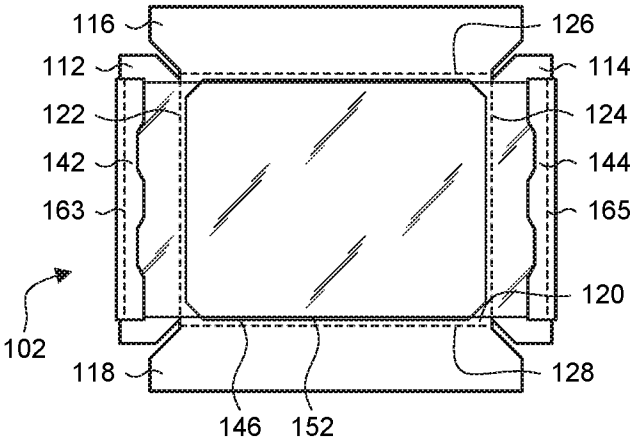
Figure 3D:
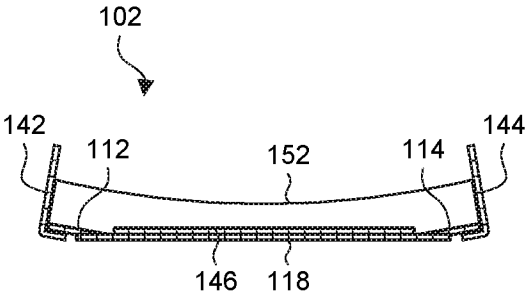
Figure 3I:
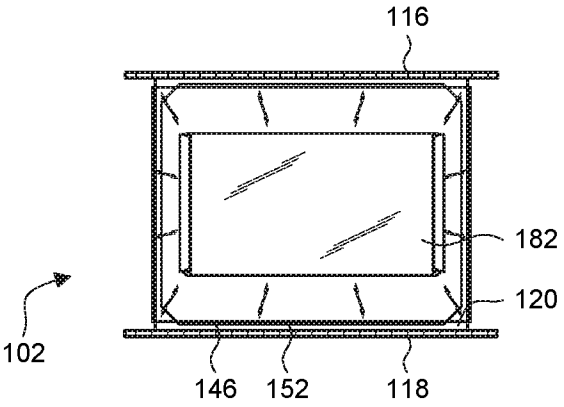
Figure 3J:
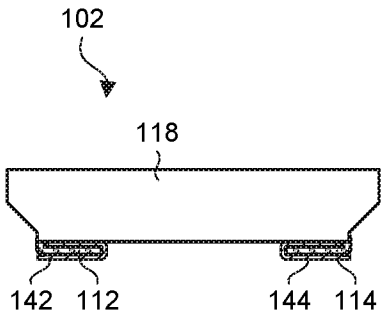
Figure 3G:
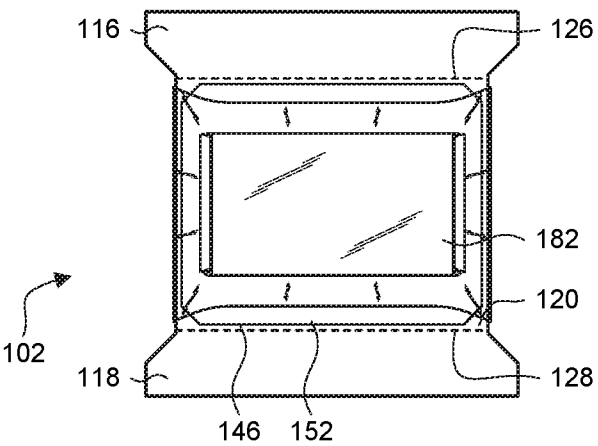
Figure 3H:
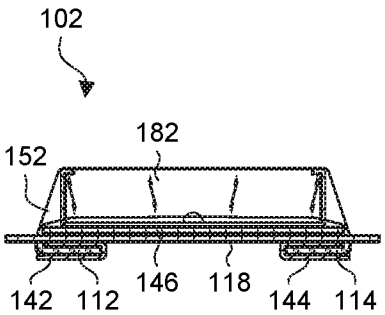

Another embodiment of forming the base panel 110 and the sheet panel 140 into a retention packaging system 102 is depicted in FIGS. 3A to 3J. More specifically, FIGS. 3A and 3B depict top views of embodiments of a first instance and a second instance, respectively, of forming the retention packaging system 102; FIGS. 3C and 3D depict top and front views, respectively, of a third instance of forming the retention packaging system 102; FIGS. 3E and 3F depict top and front views, respectively, of a fourth instance of forming the retention packaging system 102; FIGS. 3G and 3H depict top and front views, respectively, of a fifth instance of forming the retention packaging system 102; and FIGS. 3I and 3J depict top and front views, respectively, of a sixth instance of forming the retention packaging system 102.

In the first instance depicted in FIG. 3A, the first detachable portion 148 and the second detachable portion 150 have been detached from the first overwrap panel 142, the second overwrap panel 144, and the base reinforcing portion 146. In the second instance depicted in FIG. 3B, the first and second detachable portions 148 and 150 have been discarded. In addition, the base reinforcing portion 146 has been withdrawn from the first and second overwrap panels 142 and 144 and the sheet 152. In some embodiments, the first liner 158 is removed from the first attachment zone 174 and the second liner 160 is removed from the second attachment zone 176.

In the third instance depicted in FIGS. 3C and 3D, the base reinforcing portion 146 is placed on the base portion 120 of the base panel 110. In addition, the first and second overwrap panels 142 and 144 of the sheet panel 140 have been attached to the first and second tension flaps 112 and 114, respectively. In the embodiment shown in FIGS. 3C and 3D, the first overwrap panel 142 has been folded about the fold line 162 and the second overwrap panel 144 has been folded about the fold line 164. In the depicted embodiment, the fold line 162 was aligned with the left end of the first tension flap 112 when the first overwrap panel 142 was attached to the first tension flap 112 and the fold line 164 was aligned with the right end of the second tension flap 114 when the second overwrap panel 144 was attached to the second tension flap 114. As seen in the embodiment depicted in FIG. 3D, the location of the attachment of the first and second overwrap panels 142 and 144 on the first and second tension flaps 112 and 114 causes the sheet 152 to be somewhat slack, as compared with the embodiment shown in FIG. 2D. It also causes the first and second tension flaps 112 and 114 to be rotated up at an angle about the first and second fold lines 122 and 124, respectively. The angle of the first and second tension flaps 112 and 114 shown in FIG. 3D is closer to horizontal than the angle of the first and second tension flaps 112 and 114 shown in FIG. 2D.

In the fourth instance depicted in FIGS. 3E and 3F, an object 182 is placed between the sheet 152 and the base portion 120. In the embodiment depicted in FIGS. 2E and 2F, the object 182 is placed between the base reinforcing portion 146 and the sheet 152. In some embodiments, in order to insert the object between the sheet 152 and the base portion 120, the sheet 152 is lifted upward to allow insertion of the object 182 between the sheet 152 and the base portion 120.

When comparing the object 182 shown in FIG. 3F with the object 180 shown in FIG. 2F, the object 182 is taller than the object 180. As noted above, in some embodiments, the location of the attachment of the first overwrap panel 142 on the first tension flap 112 and the location of the attachment of the second overwrap panel 144 on the second tension flap 114 is selected based on a size of the object 182 (e.g., the height of the object 180). In one example, the fold line 162 is aligned with the end of the first tension flap 112 when attaching the first overwrap panel 142 to the first tension flap 112 and the fold line 164 is aligned with the end of the first tension flap 112 when attaching the second overwrap panel 144 to the second tension flap 114 based on a size of the object 182.

In the fifth instance depicted in FIGS. 3G and 3H, the first and second tension flaps 112 and 114 have been rotated down about the first and second fold lines 122 and 124, respectively, until the first and second tension flaps 112 and 114 are below the base portion 120. Because the first and second overwrap panels 142 and 144 are attached to the first and second tension flaps 112 and 114, the first and second overwrap panels 142 and 144 are also located below the base portion 120. The sheet 152 has been pulled tight over the object 182, such that the object 182 is biased toward the base reinforcing portion 146 and the base portion 120. In this way, the object 182 is retained by the retention packaging system 102.

As can be seen when contrasting FIGS. 2A to 2J with the FIGS. 3A to 3J, the same base panel 110 and sheet panel 140 are capable of being used to retain different sizes of objects (e.g., object 180 and object 182). This ability to retain different sizes of objects using the same base panel 110 and sheet panel 140 is made possible, at least in part, by the ability to attach the first overwrap panel 142 to the first tension flap 112 and the second overwrap panel 144 to the second tension flap 114 in different locations.

In the sixth instance depicted in FIGS. 3I and 3J, the first and second support flaps 116 and 118 have been folded toward the object 182 about the third and fourth fold lines 126 and 128, respectively. Rotating the first and second support flaps 116 and 118 in this manner provides structural stability to the retention packaging system 102 and provides protection to the sides of the object 182. In this position, the retention packaging system 102, with the object 182 retained inside, is capable of being placed into a container.

Figure 3M:
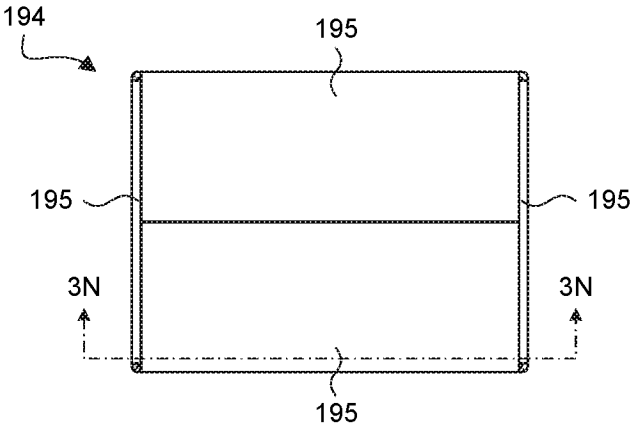
FIGS. 3K to 3N depict an embodiment of placing the retention packaging system depicted in FIGS. 2I and 2J into a container, in accordance with the embodiments disclosed herein.
Figure 3N:
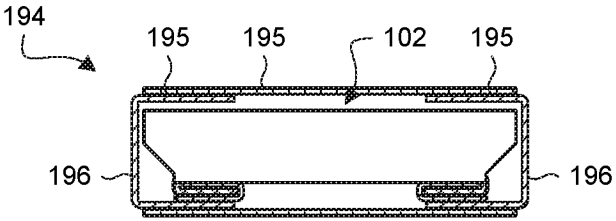
Figure 3K:
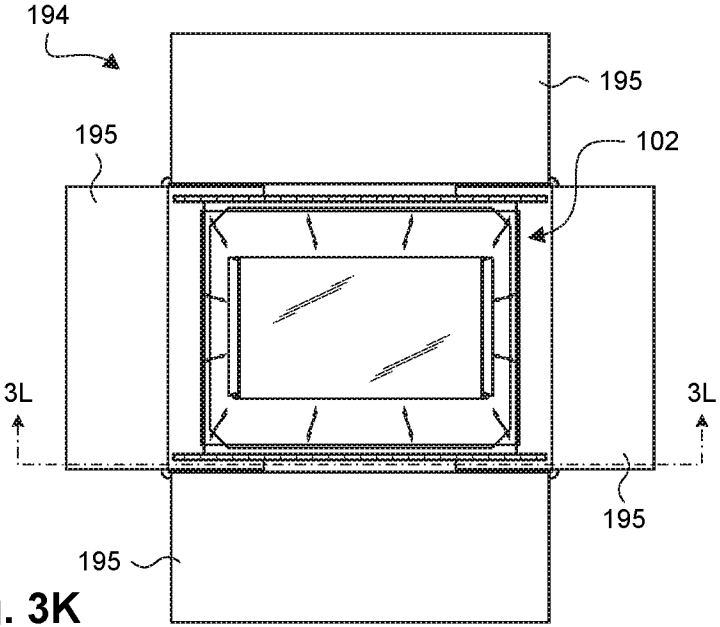
Figure 3L:
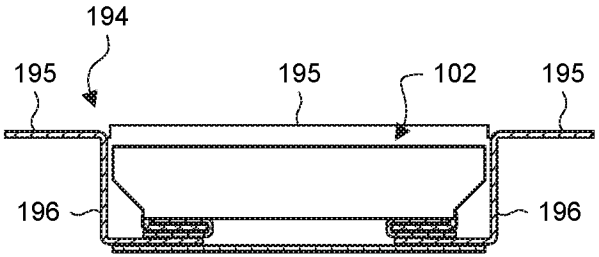

One example of a inserting the retention packaging system 102 into a container 194 is depicted in FIGS. 3K to 3N. More specifically, the FIGS. 3K and 3L depict top and side sectional views, respectively, of the retention packaging system 102 in the container 194 when the container 194 is in an open position. FIGS. 3M and 3N depict top and side sectional views, respectively, of the retention packaging system 102 in the container 194 when the container 194 is in a closed position. The container includes top flaps 195 and sides 196. In the open position, the top flaps 195 are in a position that allows the retention packaging system 102 to be inserted into the container 194. In the closed position, the top flaps 195 are in a position that prevents the retention packaging system 102 from being removed from the container 194.

In one example, as the retention packaging system 102 is inserted into the container 194 to the position shown in FIGS. 3K and 3L, the first and second support flaps 116 and 118 act as a guide to position the retention packaging system 102 with respect to the sides 196 of the container 194. In some embodiments, the container 194 has dimensions (e.g., a width, a length, and a height) selected based on the dimensions of the retention packaging system 102 shown in the sixth instance in FIGS. 31 and 3J. In one example, the container 194 has inner dimensions (e.g., height, width, and depth) that are based on the outer dimensions of the retention packaging system 102 in the condition shown in the sixth instance. After the retention packaging system 102 is inserted into the container 194 to the position shown in FIGS. 3K and 3L, the top flaps 195 of the container 194 are capable of being closed to the position shown in FIGS. 3M and 3N.

Figure 4A:
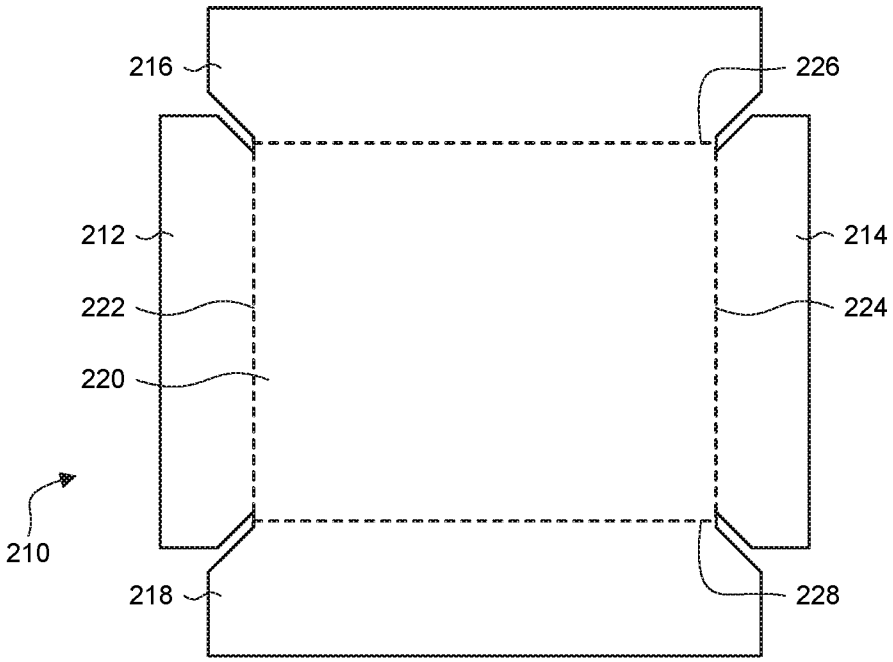
FIG. 4A depicts a top view of another embodiment of a base panel that is usable as part of a retention packaging system, in accordance with the embodiments disclosed herein.

While the base panel 110 and the sheet panel 140 provide examples of panels that are usable to form retention packaging system, other embodiments of panels can be used to form retention packaging system. Depicted in FIG. 4A is a top view of another embodiment of a base panel 210 that is usable as part of a retention packaging system (e.g., retention packaging system 200 described below). In some embodiments, the base panel 210 or any portion thereof, comprises a substantially rigid, lightweight, foldable material, such as any of the materials described above with respect to base panel 110. The base panel 210 is configured to be folded to form a portion of a retention packaging system, example embodiments of which are described below with respect to FIGS. 5A to 5J.

In the embodiment depicted in FIG. 4A, the base panel 210 includes a first tension flap 212, a second tension flap 214, a first support flap 216, a second support flap 218, and a base portion 220. A first fold line 222 is located between the base portion 220 and the first tension flap 212, a second fold line 224 is located between the base portion 220 and the second tension flap 214, a third fold line 226 is located between the base portion 220 and the third tension flap 216, and a fourth fold line 228 is located between the base portion 220 and the second support flap 218. The first and second tension flaps 212 and 214 are rotatably connected to the base portion 220 by the first and second fold lines 222 and 224, respectively. The first and second support flaps 216 and 218 are rotatably connected to the base portion 220 by the third and fourth fold lines 226 and 228, respectively.

Figure 4B:
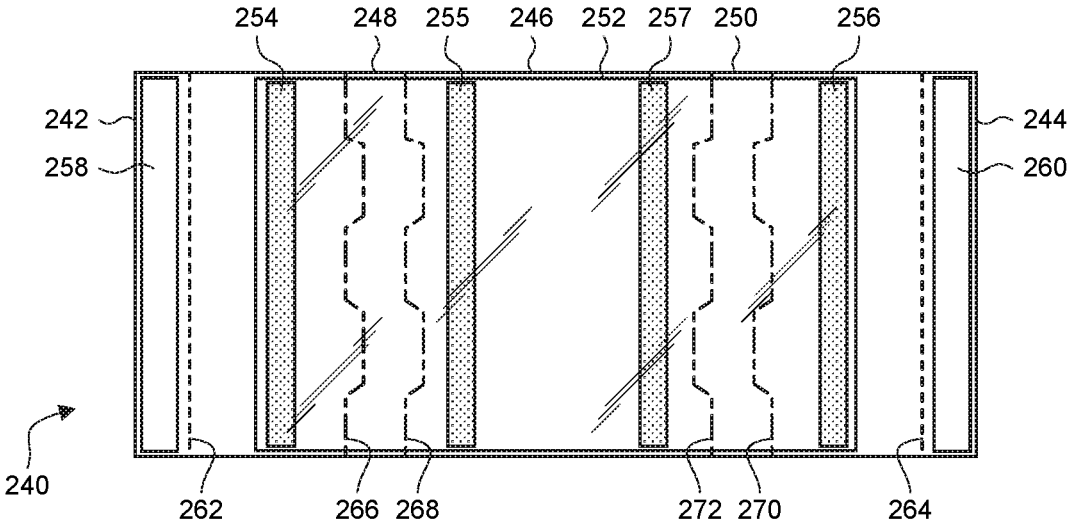
FIGS. 4B and 4C depict top and bottom views, respectively, of another embodiment of a sheet panel that is usable with the base panel depicted in FIG. 4A as part of a retention packaging system, in accordance with the embodiments disclosed herein.
Figure 4C:
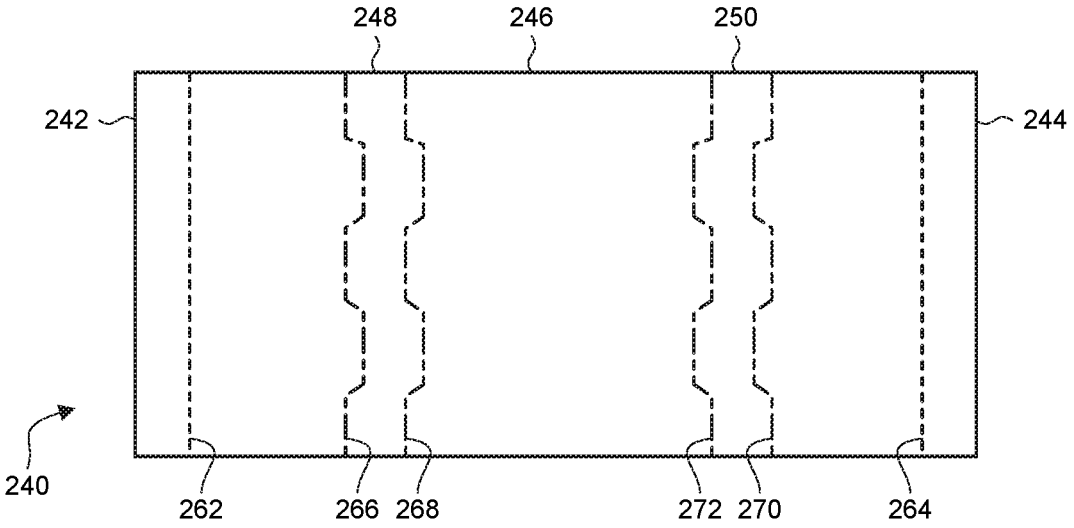

Depicted in FIGS. 4B and 4C are top and bottom views, respectively, of an embodiment of a sheet panel 240 that is usable as part of a retention packaging system (e.g., retention packaging system 200 described below). In some embodiments, the sheet panel 240 or any portion thereof, comprises a substantially rigid, lightweight, foldable material, including one or more of the materials described above with respect to base panel 110. The sheet panel 240 includes a first overwrap panel 242, a second overwrap panel 244, and a central panel 246. In some embodiments, sheet panel 240 includes at least one detachable portion between the first overwrap panel 242 and the second overwrap panel 244. In the depicted embodiment, at least one detachable portion between the first overwrap panel 242 and the second overwrap panel 244 includes a first detachable portion 248 and a second detachable portion 250.

The sheet panel 240 also includes a sheet 252. In the depicted embodiment, the sheet 252 extends between and is fixedly coupled to the first overwrap panel 242, the central panel 246, and the second overwrap panel 244. In the depicted embodiment, the sheet 252 is attached to the first overwrap panel 242 by an attachment zone 254, the sheet 252 is attached to the second overwrap panel 244 by an attachment zone 256, and the sheet 252 is attached to the central panel 246 by attachment zones 255 and 257. In some examples, the sheet 252 is attached to the first and second overwrap panels 242 and 244 and the central panel 246 by adhering with adhesive (e.g., when the attachment zones 254 and 256 include adhesive). However, the attachment zones 254, 255, 256, and 257 may be formed to attach the sheet 252 to the first and second overwrap panels 242 and 244 and the central panel 246 by one or more of any of the following: adhering, gluing, heat welding, ultrasonic welding, stapling, tacking, fastening, clipping, tab/slot engagement, anchoring, retaining, and/or securing.

The sheet panel 240 further includes a first liner 258 on the first overwrap panel 242 and a second liner 260 on the second overwrap panel 244. The first liner 258 covers a first attachment zone (not visible in FIGS. 4B and 4C) and the second liner 260 covers a second attachment zone (not visible in FIGS. 4B and 4C). The first attachment zone is configured to attach the first overwrap panel 242 of the sheet panel 240 to the first tension flap 212 of the base panel 210. The second attachment zone is configured to attach the second overwrap panel 244 of the sheet panel 240 to the second tension flap 214 of the base panel 210.

In some embodiments, the first overwrap panel 242 includes a fold line 262 and the second overwrap panel 244 includes a fold line 264. In some embodiments, the first and second overwrap panels 242 and 244 are configured to be folded about the fold lines 262 and 264. In some embodiments, the fold lines 262 and 264 are usable to align the first and second overwrap panels 242 and 244 with respect to the first and second tension flaps 212 and 214 when attaching the first and second overwrap panels 242 and 244 to the first and second tension flaps 212 and 214.

In the depicted embodiment, the sheet panel 240 includes a perforation line 266 between the first overwrap panel 242 and the first detachable portion 248, a perforation line 268 between the first detachable portion 248 and the central panel 246, a perforation line 270 between the second overwrap panel 244 and the second detachable portion 250, and a perforation line 272 between the second detachable portion 250 and the central panel 246. In some embodiments, the perforation lines 266, 268, 270, and 272 are formed such that the perforation lines 266, 268, 270, and 272 are capable of being broken by hand.

In some embodiments, the base panel 210 and the sheet panel 240 are provided in a lay-flat configuration, such as in the configuration shown in FIGS. 4A to 4C. For example, the base panel 210 may be provided with the first and second tension flaps 212 and 214 and the first and second support flaps 216 and 218 in an unfolded position, with each being generally coplanar with the base portion 220. Further, the perforation lines 266, 268, 270, and 272 are not yet broken. Such configurations may facilitate the provision of multiple base panels and multiple sheet panels in a convenient stacked or bundled arrangement (not illustrated). In some embodiments, the base panels and the sheet panels are supplied separately before being used to form a retention packaging system.

Figure 5B:
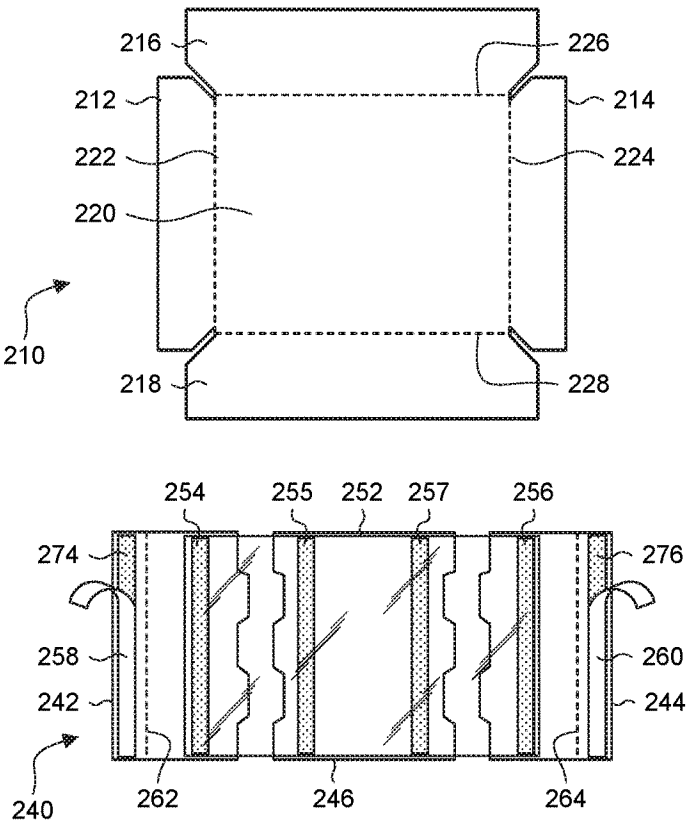
FIGS. 5A to 5J depict an embodiment of forming the base panel depicted in FIG. 4A and the sheet panel depicted in FIGS. 4B and 4C into a retention packaging system, in accordance with the embodiments disclosed herein.
Figure 5A:
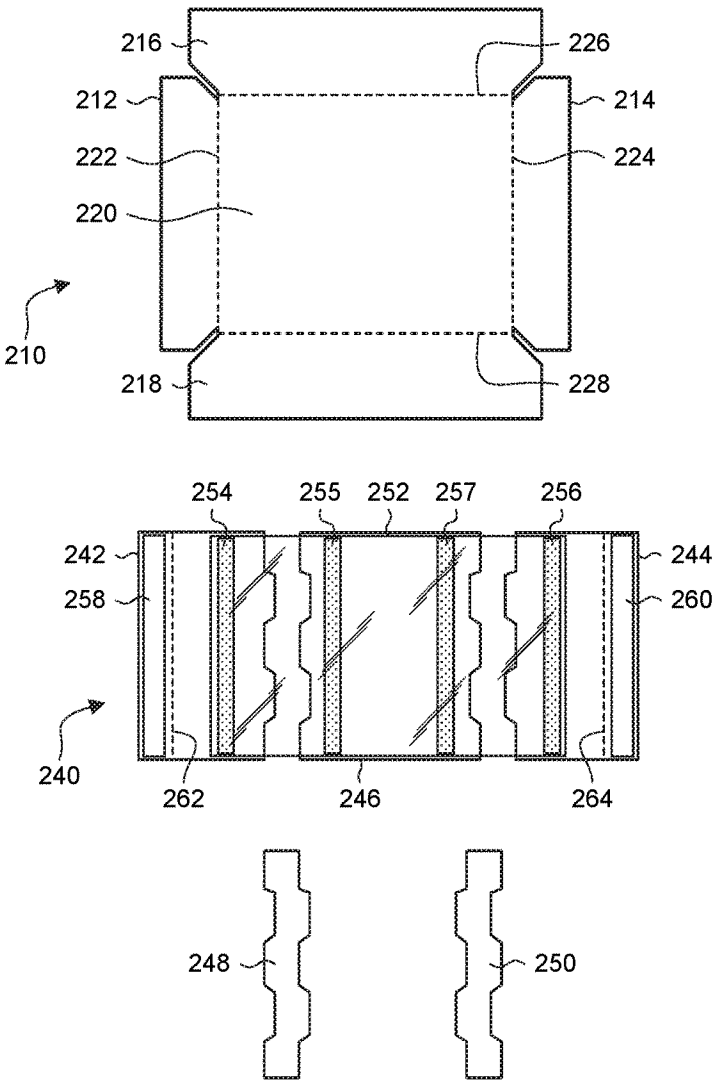
Figure 5E:
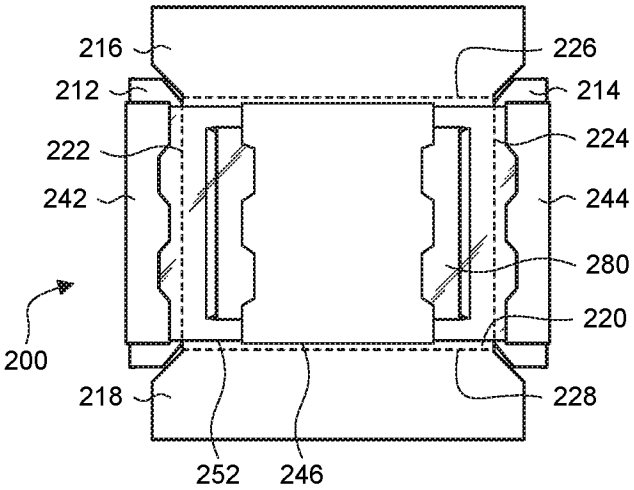
Figure 5F:
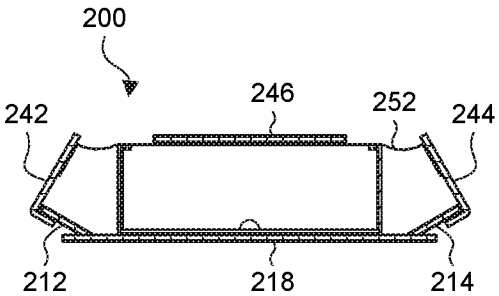
Figure 5C:
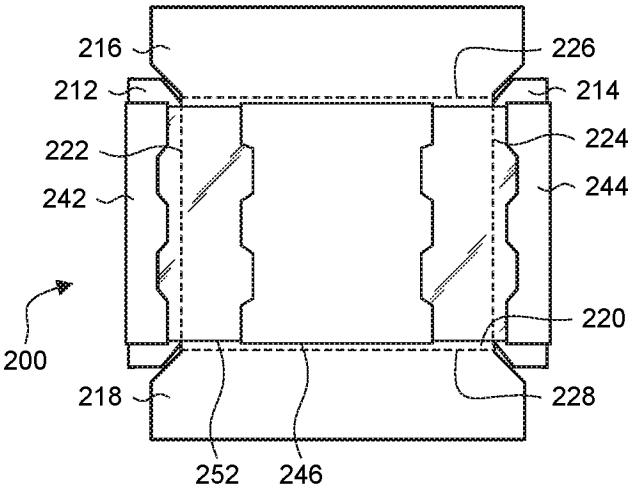
Figure 5D:
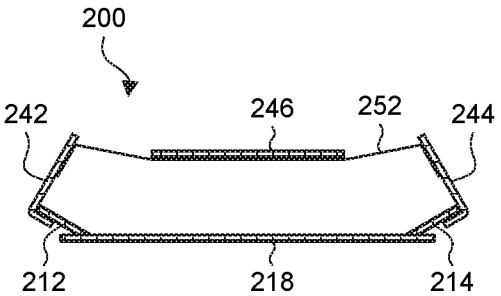
Figure 5I:
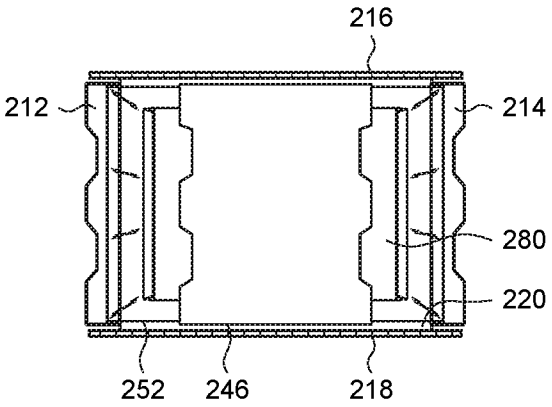
Figure 5J:
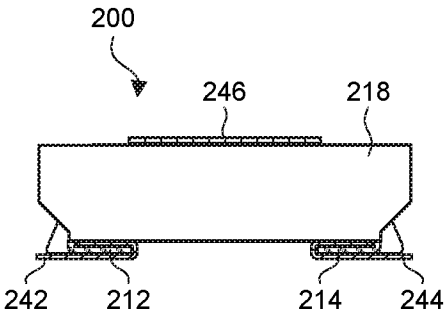
Figure 5G:
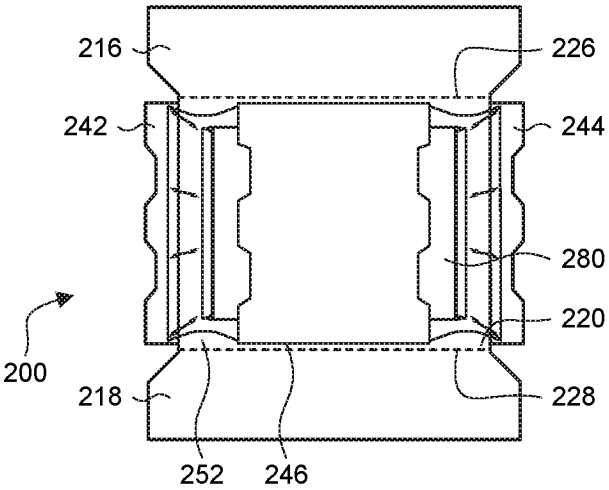
Figure 5H:
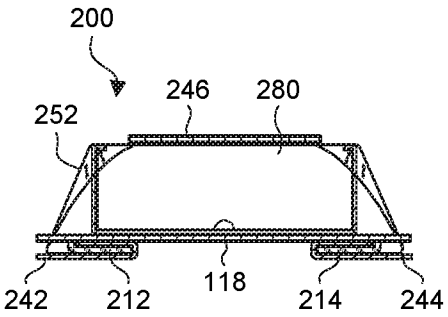

As noted above, the base panel 210 and the sheet panel 240 are usable as part of a retention packaging system. One embodiment of forming the base panel 210 and the sheet panel 240 in a retention packaging system 200 is depicted in FIGS. 5A to 5J. More specifically, FIGS. 5A and 5B depict top views of embodiments of a first instance and a second instance, respectively, of forming the retention packaging system 200; FIGS. 5C and 5D depict top and front views, respectively, of a third instance of forming the retention packaging system 200; FIGS. 5E and 5F depict top and front views, respectively, of a fourth instance of forming the retention packaging system 200; FIGS. 5G and 5H depict top and front views, respectively, of a fifth instance of forming the retention packaging system 200; and FIGS. 5I and 5J depict top and front views, respectively, of a sixth instance of forming the retention packaging system 200.

In the first instance depicted in FIG. 5A, the first detachable portion 248 has been removed from the first overwrap panel 242 and the central panel 246. In addition, the second detachable portion 250 has been removed from the second overwrap panel 244 and the central panel 246. In some embodiments, the first detachable portion 248 is removed from the first overwrap panel 242 and the central panel 246 by breaking the perforated lines 266 and 268. In some embodiments, the second detachable portion 250 is removed from the second overwrap panel 244 and the central panel 246 by breaking the perforated lines 270 and 272. In some embodiments, the first and second detachable portions 248 and 250 are discarded (e.g., recycled) after the first instance depicted in FIG. 5A.

In the second instance depicted in FIG. 5B, the first and second detachable portions 248 and 250 have been discarded. In addition, the first liner 258 is removed from a first attachment zone 274 and the second liner 260 is removed from a second attachment zone 276. The first attachment zone 274 is configured to attach the first overwrap panel 242 of the sheet panel 240 to the first tension flap 212 of the base panel 210. The second attachment zone 276 is configured to attach the second overwrap panel 244 of the sheet panel 240 to the second tension flap 214 of the base panel 210.

In the third instance depicted in FIGS. 5C and 5D, the first and second overwrap panels 242 and 244 of the sheet panel 240 have been attached to the first and second tension flaps 212 and 214, respectively. In the embodiment shown in FIGS. 5C and 5D, the first overwrap panel 242 has been folded about the fold line 262 and the second overwrap panel 244 has been folded about the fold line 264. In some embodiments, the fold line 262 is aligned with left the end of the first tension flap 212 when the first overwrap panel 242 is attached to the first tension flap 212 and the fold line 264 is aligned with the right end of the second tension flap 214 when the second overwrap panel 244 is attached to the second tension flap 214. As seen in the embodiment depicted in FIG. 5D, with the first and second overwrap panels 242 and 244 attached to the first and second tension flaps 212 and 214, respectively, the central panel 246 is held by the sheet 252 over the base portion 220. It also causes the first and second tension flaps 212 and 214 to be rotated up at an angle about the first and second fold lines 222 and 224, respectively.

In the fourth instance depicted in FIGS. 5E and 5F, an object 280 is placed between the sheet 252 and the base portion 220. In the depicted embodiment, the object 280 is a box; however, the object 280 can be any type or form of an object. In some embodiments, in order to insert the object 280 between the sheet 252 and the base portion 220, the sheet 252 and/or the central panel 246 is lifted upward to allow insertion of the object 280 between the sheet 252 and the base portion 220. In some examples, it may be convenient for a user to grasp the central panel 246 in order to lift the sheet 252.

In the fifth instance depicted in FIGS. 5G and 5H, the first and second tension flaps 212 and 214 have been rotated down about the first and second fold lines 222 and 224, respectively, until the first and second tension flaps 212 and 214 are below the base portion 220. Because the first and second overwrap panels 242 and 244 are attached to the first and second tension flaps 212 and 214, the first and second overwrap panels 242 and 244 are also located below the base portion 220. The sheet 252 has been pulled tight over the object 280, such that the object 280 is biased toward the base portion 220. In this way, the object 280 is retained by the retention packaging system 200.

One benefit to the embodiment of the sheet panel 240 is the ability to dictate the regions of the sheet 252 that are stretched when the sheet 252 is in the position shown in FIGS. 5G and 5H. In the depicted example, the sheet 252 stretches between the attachment zones 254 and 255 and the sheet 252 stretches between the attachment zones 256 and 257. The portion of the sheet between the attachment zones 255 and 257 does not stretch substantially. This allows the sheet to be stretched over particular portions of the object 280 without having to stretch across the entirety of the object 280. In some embodiments the distance between one or more of attachment zones 254 and 255, attachment zones 255 and 257, or attachment zones 256 and 257 is selected based on a desired stretch location of the sheet 252, an amount of desired tension in the sheet 252, or a size of the object 280. Having multiple stretch zones in the sheet 252 may also better retain the object 280 if the sheet 252 is stretched at particular locations of the object 280 (e.g., at corners of the object 280 as shown in FIG. 5H) and not stretched over other locations of the object 280 (e.g. across a center portion of the top of the object 280 as shown in FIG. 5H).

In the sixth instance depicted in FIGS. 51 and 5J, the first and second support flaps 216 and 218 have been folded toward the object 280 about the third and fourth fold lines 226 and 228, respectively. Rotating the first and second support flaps 216 and 218 in this manner provides structural stability to the retention packaging system 200 and provides protection to the sides of the object 280. In this position, the retention packaging system 200, with the object 280 retained inside, is capable of being placed into a container.

Figure 5M:
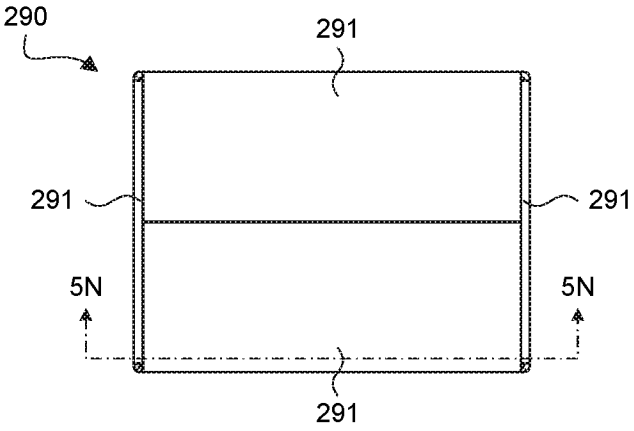
FIGS. 5K to 5N depict an embodiment of placing the retention packaging system depicted in FIGS. 5I and 5J into a container, in accordance with the embodiments disclosed herein.
Figure 5N:
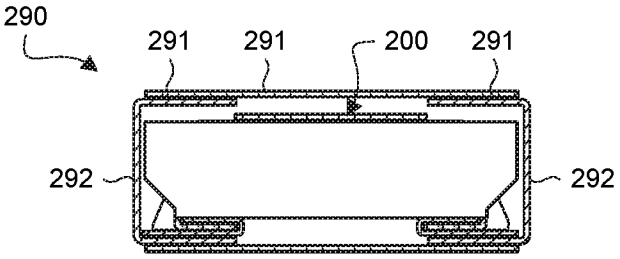
Figure 5K:
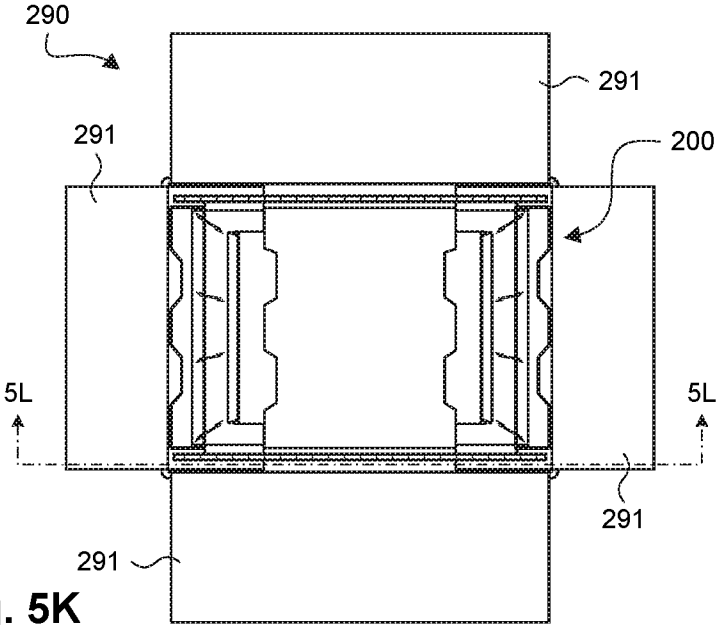
Figure 5L:
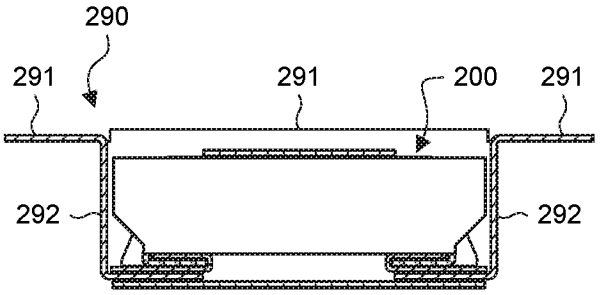

One example of a inserting the retention packaging system 200 into a container 290 is depicted in FIGS. 5K to 5N. More specifically, the FIGS. 5K and 5L depict top and side sectional views, respectively, of the retention packaging system 200 in the container 290 when the container 290 is in an open position. FIGS. 5M and 5N depict top and side sectional views, respectively, of the retention packaging system 200 in the container 290 when the container 290 is in a closed position. The container 290 includes top flaps 291 and sides 292. In the open position, the top flaps 291 are in a position that allows the retention packaging system 200 to be inserted into the container 290. In the closed position, the top flaps 291 are in a position that prevents the retention packaging system 200 from being removed from the container 290.

In one example, as the retention packaging system 200 is inserted into the container 290 to the position shown in FIGS. 5K and 5L, the first and second support flaps 216 and 218 act as a guide to position the retention packaging system 200 with respect to the sides 292 of the container 290. In some embodiments, the container 290 has dimensions (e.g., a width, a length, and a height) selected based on the dimensions of the retention packaging system 200 shown in the sixth instance in FIGS. 5I and 5J. In one example, the container 290 has inner dimensions (e.g., height, width, and depth) that are based on the outer dimensions of the retention packaging system 200 in the condition shown in the sixth instance. After the retention packaging system 200 is inserted into the container 290 to the position shown in FIGS. 5K and 5L, the top flaps 291 of the container 290 are capable of being closed to the position shown in FIGS. 5M and 5N.

In some embodiments, one or more dimensions of the base panel 210 and/or the sheet panel 240 are selected based on a size of the object. In one example, a width of the first support flap 216 (i.e., the distance from the third fold line 226 to the edge of the first support flap 216 at the bottom of the depiction in FIG. 4A) and a width of the second support flap 218 (i.e., the distance from the fourth fold line 228 to the edge of the second support flap 218 at the top of the depiction in FIG. 4A) are selected based on a height of the object 280. In some examples, such as the example shown in FIG. 4A, a width of the first tension flap 212 (i.e., the distance from the first fold line 222 to the edge of the first tension flap 212 at the left of the depiction in FIG. 4A) and a width of the second tension flap 214 (i.e., the distance from the second fold line 224 to the edge of the second tension flap 214 at the right of the depiction in FIG. 4A) are different from the width of the first support flap 216 and the width of the second support flap 218. In the depicted embodiment, the widths of the first and second support flaps 216 and 218 are greater than the widths of the first and second tension flaps 212 and 214.

Figure 6A:
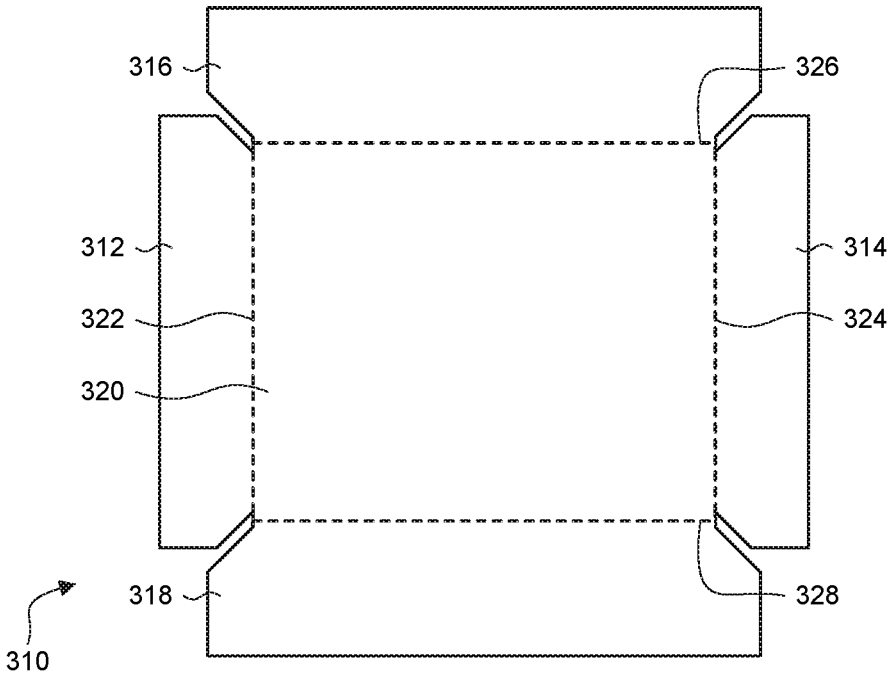
FIG. 6A depicts a top view of another embodiment of a base panel that is usable as part of a retention packaging system, in accordance with the embodiments disclosed herein.

While the base panels 110 and 210 and the sheet panels 140 and 240 provide examples of panels that are usable to form retention packaging system, other embodiments of panels can be used to form retention packaging system. Depicted in FIG. 6A is a top view of another embodiment of a base panel 310 that is usable as part of a retention packaging system (e.g., retention packaging system 300 described below). In some embodiments, the base panel 310 or any portion thereof, comprises a substantially rigid, lightweight, foldable material, such as any of the materials described above with respect to base panel 110. The base panel 310 is configured to be folded to form a portion of a retention packaging system, example embodiments of which are described below with respect to FIGS. 7A to 7J.

In the embodiment depicted in FIG. 6A, the base panel 310 includes a first tension flap 312, a second tension flap 314, a first support flap 316, a second support flap 318, and a base portion 320. A first fold line 322 is located between the base portion 320 and the first tension flap 312, a second fold line 324 is located between the base portion 320 and the second tension flap 314, a third fold line 326 is located between the base portion 320 and the first support flap 316, and a fourth fold line 328 is located between the base portion 320 and the second support flap 318. The first and second tension flaps 312 and 314 are rotatably connected to the base portion 320 by the first and second fold lines 322 and 324, respectively. The first and second support flaps 316 and 318 are rotatably connected to the base portion 320 by the third and fourth fold lines 326 and 328, respectively.

Figure 6B:
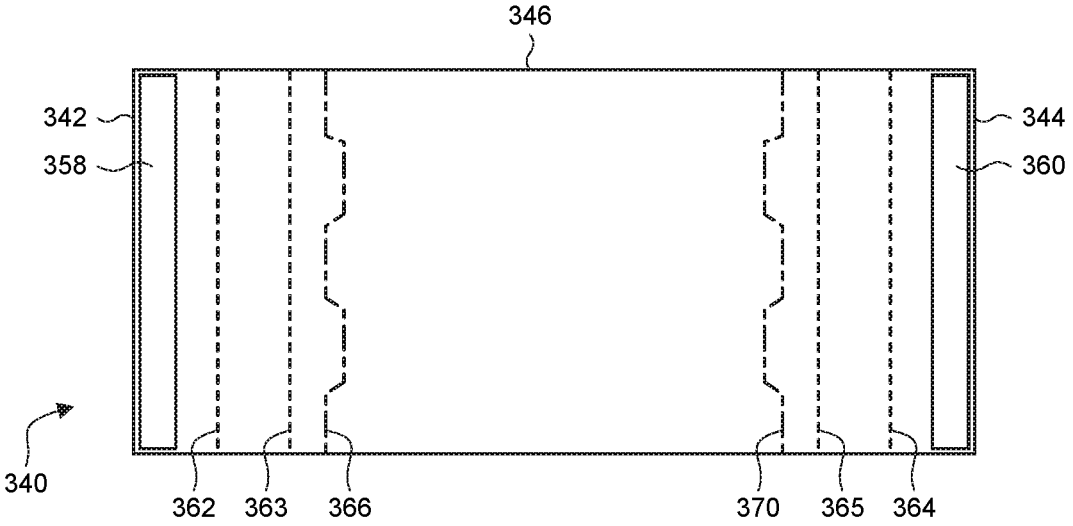
FIGS. 6B and 6C depict top and bottom views, respectively, of another embodiment of a sheet panel that is usable with the base panel depicted in FIG. 4A as part of a retention packaging system, in accordance with the embodiments disclosed herein.
Figure 6C:
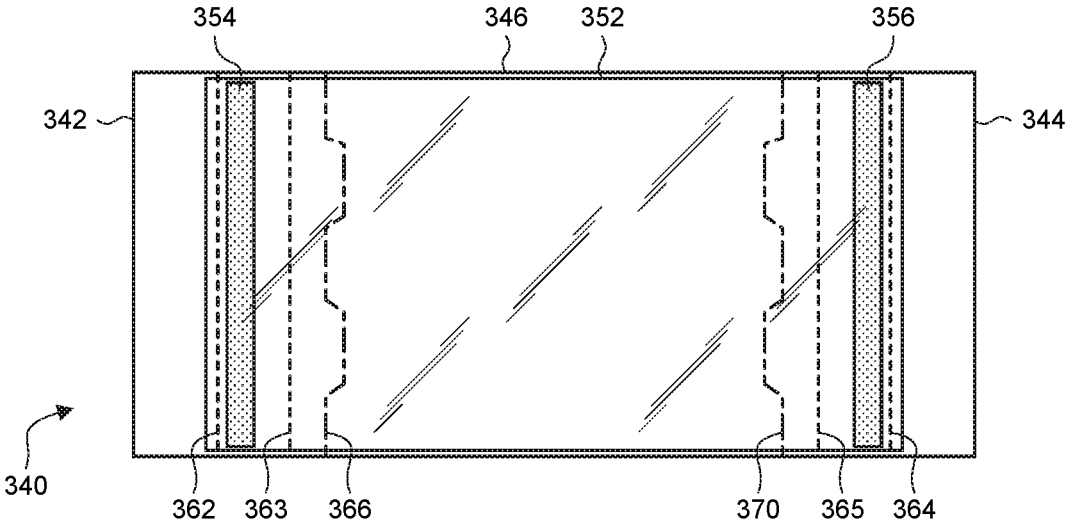

Depicted in FIGS. 6B and 6C are top and bottom views, respectively, of an embodiment of a sheet panel 340 that is usable as part of a retention packaging system (e.g., retention packaging system 300 described below). In some embodiments, the sheet panel 340 or any portion thereof, comprises a substantially rigid, lightweight, foldable material, including one or more of the materials described above with respect to base panel 110. The sheet panel 340 includes a first overwrap panel 342 and a second overwrap panel 344. In some embodiments, sheet panel 340 includes at least one detachable portion between the first overwrap panel 342 and the second overwrap panel 344. In the depicted embodiment, at least one detachable portion between the first overwrap panel 342 and the second overwrap panel 344 includes a base reinforcing portion 346.

The sheet panel 340 also includes a sheet 352. In the depicted embodiment, the sheet 352 extends between and is fixedly coupled to the first overwrap panel 342 and the second overwrap panel 344. In the depicted embodiment, the sheet 352 is attached to the first overwrap panel 342 by an attachment zone 354 and the sheet 352 is attached to the second overwrap panel 344 by an attachment zone 356. In some examples, the sheet 352 is attached to the first and second overwrap panels 342 and 344 by adhering with adhesive (e.g., when the attachment zones 354 and 356 include adhesive). However, the attachment zones 354 and 356 may be formed to attach the sheet 352 to the first and second overwrap panels 342 and 344 and the base reinforcing portion 346 by one or more of any of the following: adhering, gluing, heat welding, ultrasonic welding, stapling, tacking, fastening, clipping, tab/slot engagement, anchoring, retaining, and/or securing.

The sheet panel 340 further includes a first liner 358 on the first overwrap panel 342 and a second liner 360 on the second overwrap panel 344. The first liner 358 covers a first attachment zone (not visible in FIGS. 6B and 6C) and the second liner 360 covers a second attachment zone (not visible in FIGS. 6B and 6C). The first attachment zone is configured to attach the first overwrap panel 342 of the sheet panel 340 to the first tension flap 312 of the base panel 310. The second attachment zone is configured to attach the second overwrap panel 344 of the sheet panel 340 to the second tension flap 314 of the base panel 310. In the embodiment shown in FIGS. 6B and 6C, the first and second attachment zones covered by the first and second liners 358 and 360 are on one side of the first and second overwrap panels 342 and 344, and the sheet 352 is attached via the attachment zones 354 and 356 to the other side of the first and second overwrap panels 342 and 344.

In some embodiments, the first overwrap panel 342 includes fold lines 362 and 363 and the second overwrap panel 344 includes fold lines 364 and 365. In some embodiments, the first and second overwrap panels 342 and 344 are configured to be folded about the fold lines 362 and 364. In some embodiments, the fold lines 362, 363, 364, and 365 are usable to align the first and second overwrap panels 342 and 344 with respect to the first and second tension flaps 312 and 314 when attaching the first and second overwrap panels 342 and 344 to the first and second tension flaps 312 and 314.

In the depicted embodiment, the sheet panel 340 includes a perforation line 366 between the first overwrap panel 342 and the base reinforcing portion 346 and a perforation line 370 between the second overwrap panel 344 and the base reinforcing portion 346. In some embodiments, the perforation lines 366 and 370 are formed such that the perforation lines 366 and 370 are capable of being broken by hand.

In some embodiments, the base panel 310 and the sheet panel 340 are provided in a lay-flat configuration, such as in the configuration shown in FIGS. 6A to 6C. For example, the base panel 310 may be provided with the first and second tension flaps 312 and 314 and the first and second support flaps 316 and 318 in an unfolded position, with each being generally coplanar with the base portion 320. Further, the perforation lines 366 and 370 are not yet broken. Such configurations may facilitate the provision of multiple base panels and multiple sheet panels in a convenient stacked or bundled arrangement (not illustrated). In some embodiments, the base panels and the sheet panels are supplied separately before being used to form a retention packaging system.

Figure 7B:
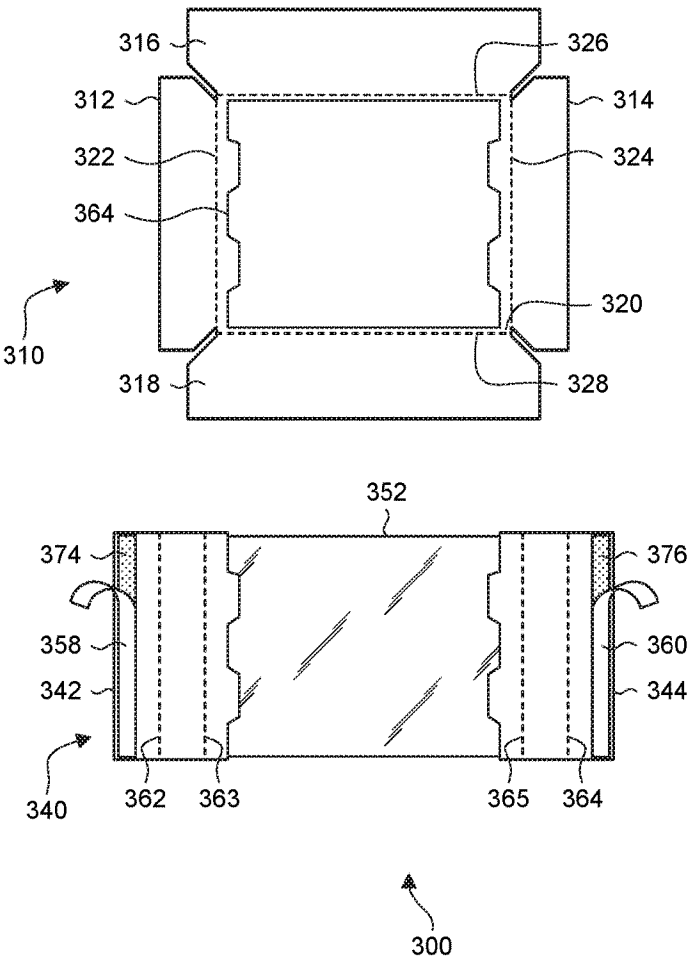
FIGS. 7A to 7J depict an embodiment of forming the base panel depicted in FIG. 6A and the sheet panel depicted in FIGS. 6B and 6C into a retention packaging system, in accordance with the embodiments disclosed herein.
Figure 7A:
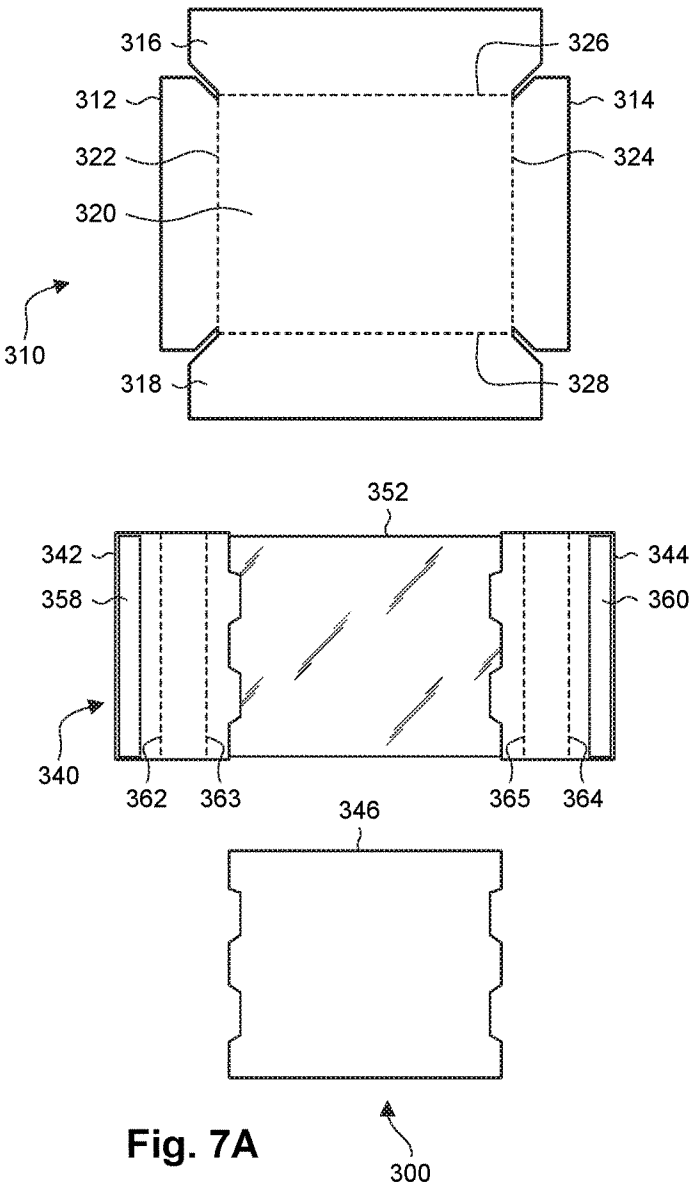
Figure 7E:
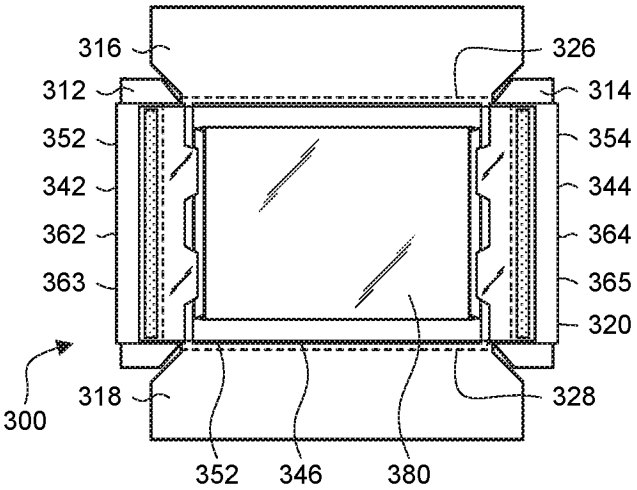
Figure 7F:
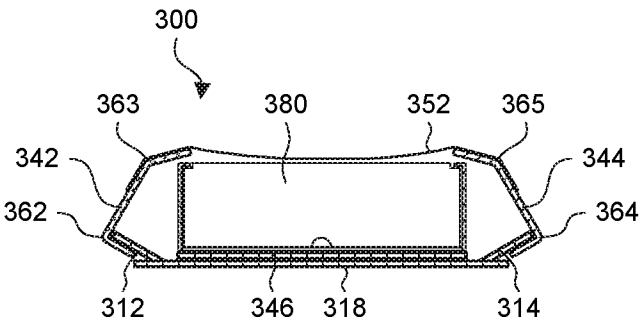
Figure 7C:
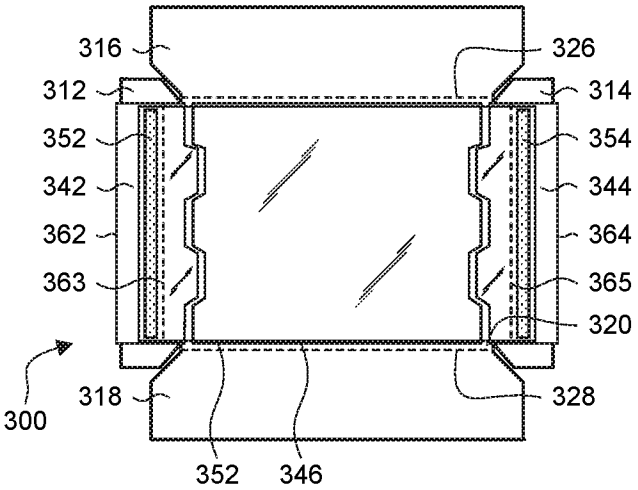
Figure 7D:
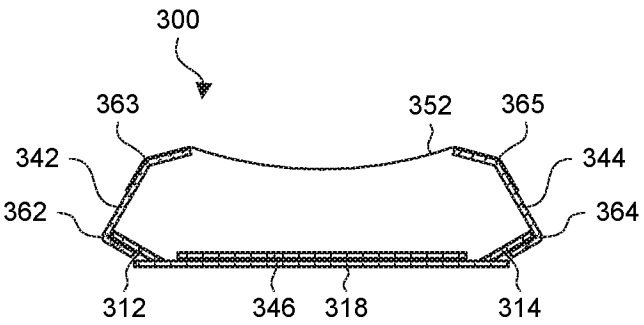
Figure 7G:
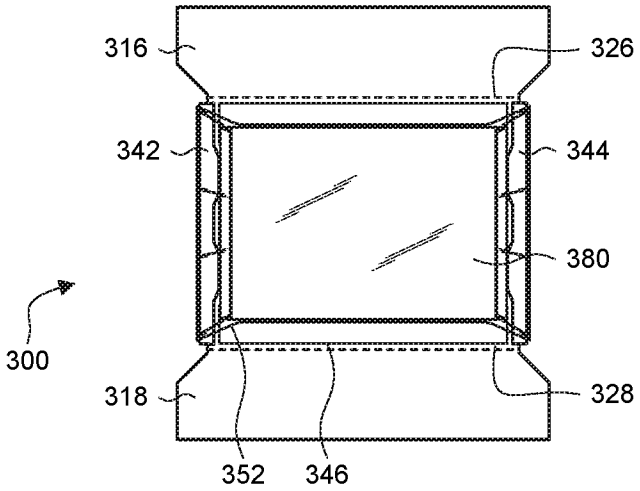
Figure 7I:
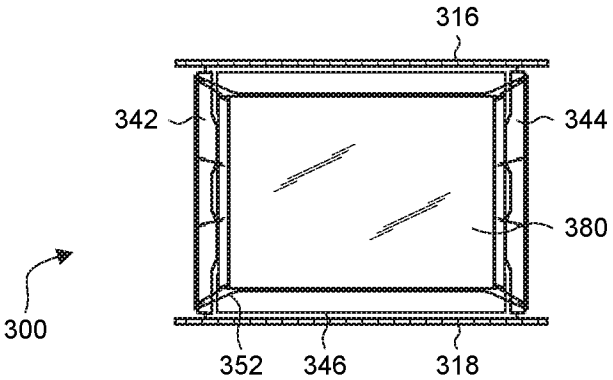
Figure 7H:
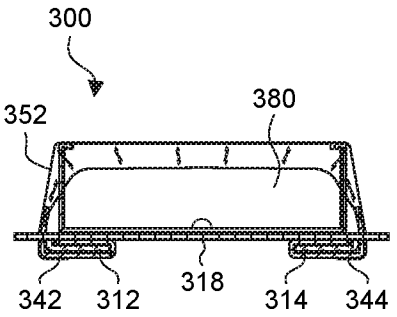
Figure 7J:
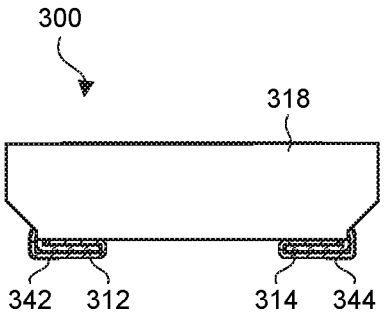

As noted above, the base panel 310 and the sheet panel 340 are usable as part of a retention packaging system. One embodiment of forming the base panel 310 and the sheet panel 340 in a retention packaging system 300 is depicted in FIGS. 7A to 7J. More specifically, FIGS. 7A and 7B depict top views of embodiments of a first instance and a second instance, respectively, of forming the retention packaging system 300; FIGS. 7C and 7D depict top and front views, respectively, of a third instance of forming the retention packaging system 300; FIGS. 7E and 7F depict top and front views, respectively, of a fourth instance of forming the retention packaging system 300; FIGS. 7G and 7H depict top and front views, respectively, of a fifth instance of forming the retention packaging system 300; and FIGS. 7I and 7J depict top and front views, respectively, of a sixth instance of forming the retention packaging system 300.

In the first instance depicted in FIG. 7A, the base reinforcing portion 346 has been detached from the first overwrap panel 342 and the second overwrap panel 344. In the second instance depicted in FIG. 7B, the base reinforcing portion 346 has been placed on the base portion 320. In some embodiments, the first liner 358 is removed from the first attachment zone 374 and the second liner 360 is removed from the second attachment zone 376.

In the third instance depicted in FIGS. 7C and 7D, the first and second overwrap panels 342 and 344 of the sheet panel 340 have been attached to the first and second tension flaps 312 and 314, respectively. In the embodiment shown in FIGS. 7C and 7D, the first overwrap panel 342 has been folded about the fold lines 362 and 363, and the fold line 362 is aligned with the left end of the first tension flap 312. Similarly, the second overwrap panel 344 has been folded about the fold lines 364 and 365, and the fold line 365 is aligned with the right end of the second tension flap 314. As seen in the embodiment depicted in FIG. 7D, the location of the attachment of the first and second overwrap panels 342 and 344 on the first and second tension flaps 312 and 314 causes the sheet 352 to be somewhat slack. It also causes the first and second tension flaps 312 and 314 to be rotated up at an angle about the first and second fold lines 322 and 324, respectively. In addition, the sheet 352 is attached to the outer sides of the first and second overwrap panels 342 and 344.

In the fourth instance depicted in FIGS. 7E and 7F, an object 380 is placed between the sheet 352 and the base portion 320. In the embodiment depicted in FIGS. 3E and 3F, the object 380 is placed between the base reinforcing portion 346 and the sheet 352. In some embodiments, in order to insert the object between the sheet 352 and the base portion 320, the sheet 352 is lifted upward to allow insertion of the object 380 between the sheet 352 and the base portion 320.

As noted above, in some embodiments, the location of the attachment of the first overwrap panel 342 on the first tension flap 312 and the location of the attachment of the second overwrap panel 344 on the second tension flap 314 is selected based on a size of the object 380 (e.g., the height of the object 380). In one example, the fold line 362 is selected to be aligned with the left end of the first tension flap 312 when attaching the first overwrap panel 342 to the first tension flap 312 and the fold line 364 is selected to be aligned with the right end of the second tension flap 314 when attaching the second overwrap panel 344 to the second tension flap 314 based on a size of the object 380.

In the fifth instance depicted in FIGS. 7G and 7H, the first and second tension flaps 312 and 314 have been rotated down about the first and second fold lines 322 and 324, respectively, until the first and second tension flaps 312 and 314 are below the base portion 320. Because the first and second overwrap panels 342 and 344 are attached to the first and second tension flaps 312 and 314, portions of the first and second overwrap panels 342 and 344 are also located below the base portion 320. In the depicted embodiment, a portion of each of the first and second overwrap panels 342 and 344 is located above the base portion 320 along sides of the object 380. Because portions of the first and second overwrap panels 342 and 344 are located above the base portion, the first and second overwrap panels 342 and 344 strengthen the first and second fold lines 322 and 324. This strengthening reduces the possibility of false scoring of the base portion 320 due to the force of the tension in the sheet 352. The sheet 352 has been pulled tight over the object 380, such that the object 380 is biased toward the base reinforcing portion 346 and the base portion 320. In this way, the object 380 is retained by the retention packaging system 300.

In the sixth instance depicted in FIGS. 71 and 7J, the first and second support flaps 316 and 318 have been folded toward the object 380 about the third and fourth fold lines 326 and 328, respectively. Rotating the first and second support flaps 316 and 318 in this manner provides structural stability to the retention packaging system 300 and provides protection to the sides of the object 380. In this position, the retention packaging system 300, with the object 380 retained inside, is capable of being placed into a container.

Figure 7M:
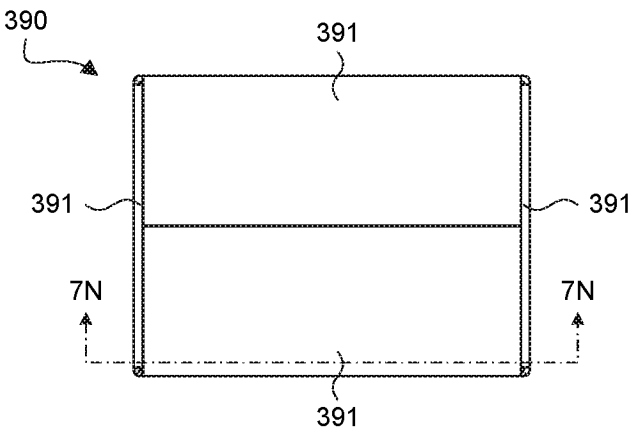
FIGS. 7K to 7N depict an embodiment of placing the retention packaging system depicted in FIGS. 7I and 7J into a container, in accordance with the embodiments disclosed herein.
Figure 7N:
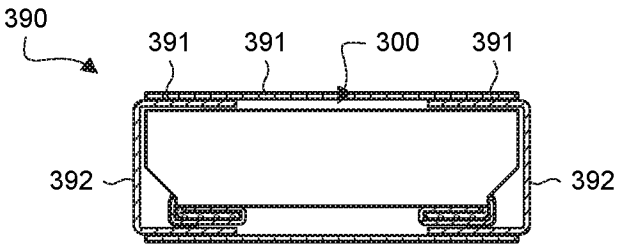
Figure 7K:
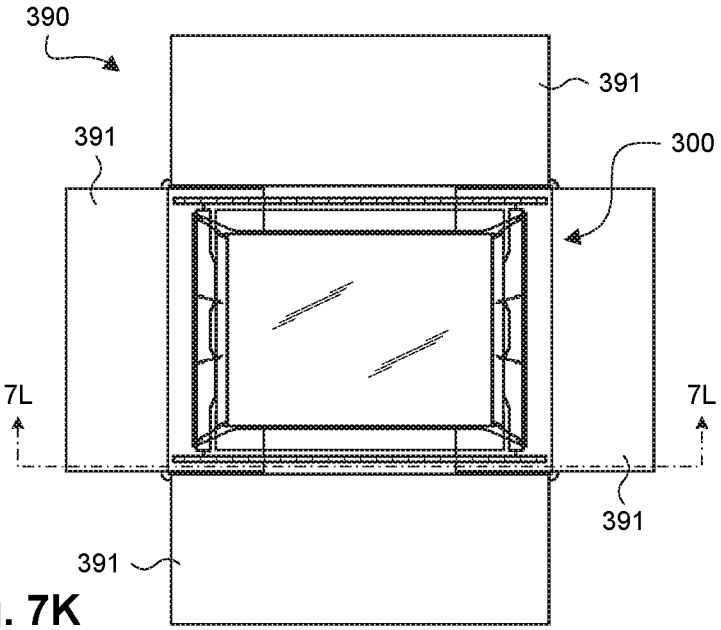
Figure 7L:
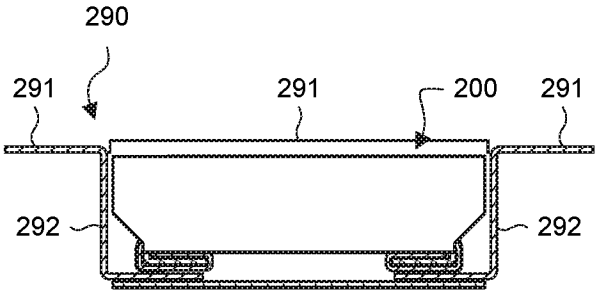

One example of a inserting the retention packaging system 300 into a container 390 is depicted in FIGS. 7K to 7N. More specifically, the FIGS. 7K and 7L depict top and side sectional views, respectively, of the retention packaging system 300 in the container 390 when the container 390 is in an open position. FIGS. 7M and 7N depict top and side sectional views, respectively, of the retention packaging system 300 in the container 390 when the container 390 is in a closed position. The container 390 includes top flaps 391 and sides 392. In the open position, the top flaps 391 are in a position that allows the retention packaging system 300 to be inserted into the container 390. In the closed position, the top flaps 391 are in a position that prevents the retention packaging system 300 from being removed from the container 390.

In one example, as the retention packaging system 300 is inserted into the container 390 to the position shown in FIGS. 7K and 7L, the first and second support flaps 316 and 318 act as a guide to position the retention packaging system 300 with respect to the sides 392 of the container 390. In some embodiments, the container 390 has dimensions (e.g., a width, a length, and a height) selected based on the dimensions of the retention packaging system 300 shown in the sixth instance in FIGS. 5I and 5J. In one example, the container 390 has inner dimensions (e.g., height, width, and depth) that are based on the outer dimensions of the retention packaging system 300 in the condition shown in the sixth instance. After the retention packaging system 300 is inserted into the container 390 to the position shown in FIGS. 7K and 7L, the top flaps 391 of the container 390 are capable of being closed to the position shown in FIGS. 7M and 7N.

The various embodiments of retention packaging systems disclosed herein can be used to package an object. One embodiment of a method of packaging an object using a retention packaging system is performed using a base panel and a sheet panel. The base panel includes first and second tension flaps foldably connected to a base portion. The sheet panel includes a first overwrap panel, a second overwrap panel, at least one detachable portion between the first and second overwrap panels, and a sheet connected to the first overwrap panel and the second overwrap panel.

In one example, the method includes detaching the at least one detachable portion from the sheet panel. Examples of at least one detachable portions include the base reinforcing portion 146 and the first and second detachable portions 148 and 150 of the sheet panel 140, the first and second detachable portions 248 and 250 of the sheet panel 240, and base reinforcing portion 346 of the sheet panel 340.

In another example, the method further includes attaching the sheet panel to the base panel such that the sheet spans between the first and second tension flaps and the first and second tension flaps are in a first position. In some embodiments, attaching the sheet panel to the base panel includes attaching the first overwrap panel to the first tension flap at one of a plurality of locations on the first tension flap and attaching the second overwrap panel to the second tension flap at one of a plurality of locations on the second tension flap. In some examples, the one of the plurality of locations on the first tension flap and the one of the plurality of locations on the second tension flap are selected based on at least one of a desired tension of the sheet or a size of the object. In some examples, the plurality of locations on the first tension flap correspond to a plurality of fold lines on the first overwrap panel and the method includes aligning a corresponding one of the plurality of fold lines on the first overwrap panel to an end of the first tension flap.

In another example, the method further includes placing the object between the sheet and the base portion while the first and second tension flaps are in the first position. In some examples, placing the object between the sheet and the base portion includes placing a base reinforcing panel removed from the sheet panel on the base portion and placing the object between the base reinforcing panel and the sheet. In some examples, placing the object between the sheet and the base portion includes lifting one of the sheet or a central portion attached to the sheet to permit placement of the object between the sheet and the base portion.

In another example, the method further includes rotating the first and second tension flaps about first and second fold lines, respectively, from the first position to a second position below the base portion. When the first and second tension flaps are in the second position, the object is biased toward the base portion by the sheet. In some examples, the first and second tension flaps are rotated until they are parallel to the base portion.

In another example, the method further includes obtaining the sheet panel from a first source and obtaining the base panel from a second source that is different from the first source. As mentioned above, obtaining the sheet panel and the base panel may provide cost savings to the user. For example, if the sheet panel must be obtained from a particular manufacturer, the base panel can be obtained from a different manufacturer (e.g., a manufacturer located near the user).

While the above description has used terms, such as "left," "right," "horizontal," "vertical," "upward," downward," and the like, those terms are used with respect to the depictions in the figures and are not intended to be limited to a particular orientation of retention packaging systems. Those skilled in the art will understand that the retention packaging systems described herein are capable of being folded from any orientation and not just in the orientation depicted in the figures. Thus, these terms should not be read as limiting in any way, but merely as a descriptive tool in reference to the specific orientation shown in the figures.

For purposes of this disclosure, terminology such as "upper," "lower," "vertical," "horizontal," "inwardly," "outwardly," "inner," "outer," "front," "rear," and the like, should be construed as descriptive and not limiting the scope of the claimed subject matter. Further, the use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Unless stated otherwise, the terms "substantially," "approximately," and the like are used to mean within 5% of a target value.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

What is claimed is:

1. A retention packaging system, comprising:

a base panel including first and second tension flaps foldably connected to a base portion, respectively, by first and second fold lines between the base portion and the first and second tension flaps; and a sheet panel including a sheet connected to a first overwrap panel and a second overwrap panel, wherein the sheet panel further includes at least one detachable portion between the first and second overwrap panels, wherein the first overwrap panel includes a first attachment zone, and wherein the second overwrap panel includes a second attachment zone;

wherein, after the at least one detachable portion is detached from the sheet panel, the first overwrap panel is configured to be selectively attached to the first tension flap at one of a plurality of locations on the first tension flap and the second overwrap panel is configured to be selectively attached to the second tension flap at one of a plurality of locations on the second tension flap such that the sheet spans between the first and second tension flaps;

wherein the first and second tension flaps are configured to be in a first position when the first and second overwrap panels are attached to the first and second tension flaps, respectively, to permit placement of an object between the sheet and the base portion; and wherein, when the object is between the sheet and the base portion, the first and second tension flaps are configured to be rotated about the first and second fold lines, respectively, from the first position to a second position below the base portion such that the object is biased toward the base portion by the sheet when the first and second tension flaps are in the second position.

2. The retention packaging system of claim 1, wherein, when the first and second tension flaps are in the second position, the first and second tension flaps are against a side of the base portion opposite of a side of the base portion toward which the object is biased by the sheet.

3. The retention packaging system of claim 1, wherein the base panel further includes first and second support flaps foldably connected to the base portion, respectively, by third and fourth fold lines between the base portion and the first and second support flaps.

4. The retention packaging system of claim 3, wherein, when the first and second tension flaps are in the second position, the first support flap is configured to be rotated about the third fold line toward the object and the second support flap is configured to be rotated about the fourth fold line toward the object.

5. A sheet panel for use with a base panel to form a retention packaging system, wherein the base panel includes a first tension flap foldably connected to a base portion by a first fold line and a second tension flap foldably connected to the base portion by a second fold line, the sheet panel comprising:

a first overwrap panel that includes a first attachment zone;

a second overwrap panel that includes a second attachment zone;

a sheet connected to the first overwrap panel and to the second overwrap panel; and at least one detachable portion between the first and second overwrap panels and configured to be detached from the sheet panel;

wherein, after the at least one detachable portion is detached from the sheet panel, the first overwrap panel is configured to be selectively attached to the first tension flap at one of a plurality of locations on the first tension flap and the second overwrap panel is configured to be selectively attached to the second tension flap at one of a plurality of locations on the second tension flap such that the sheet spans between the first and second tension flaps.

6. The sheet panel of claim 5, wherein:

the first and second tension flaps are configured to be in a first position when the first and second overwrap panels are attached to the first and second tension flaps, respectively, to permit placement of an object between the sheet and the base portion;

the first and second tension flaps are configured to be rotated about the first and second fold lines, respectively, from the first position to a second position below the base portion; and the object is biased toward the base portion by the sheet when the first and second tension flaps are in the second position.

7. The sheet panel of claim 6, wherein the at least one detachable portion of the sheet panel includes a base reinforcing portion.

8. The sheet panel of claim 7, wherein the base reinforcing portion is configured to be placed between the object and the base portion of the base panel before the first and second tension flaps are rotated from the first position to the second position.

9. The sheet panel of claim 7, wherein the at least one detachable portion further comprises:

a first detachable portion located between the first overwrap panel and the base reinforcing portion before the first detachable portion and the base reinforcing portion are detached from the sheet panel; and a second detachable portion located between the second overwrap panel and the base reinforcing portion before the second detachable portion and the base reinforcing portion are detached from the sheet panel.

10. The sheet panel of claim 5, wherein the first attachment zone is on a first side of the first overwrap panel, the second attachment zone is attached to a first side of the second overwrap panel, and the sheet is attached to the first side of the first overwrap panel and to the first side of the second overwrap panel.

11. The sheet panel of claim 5, wherein, after the at least one detachable portion is detached from the sheet panel, the sheet is the only portion of the sheet panel to which the first and second overwrap panels are directly attached.

12. The sheet panel of claim 5, wherein, before the at least one detachable portion is detached from the sheet panel, the at least one detachable portion extends between first and second edges of the sheet panel.

13. The sheet panel of claim 5, wherein:

the first overwrap panel is configured to be selectively attached to the first tension flap by attaching the first attachment zone to the first tension flap; and the second overwrap panel is configured to be selectively attached to the second tension flap by attaching the second attachment zone to the second tension flap.

14. The system of claim 13, further comprising:

a first liner arranged to cover the first attachment zone, wherein the first liner is configured to be removed from the first attachment zone before the first overwrap panel is selectively attached to the first tension flap by the first attachment zone; and a second liner arranged to cover the second attachment zone, wherein the second liner is configured to be removed from the second attachment zone before the second overwrap panel is selectively attached to the second tension flap by the second attachment zone.

15. The sheet panel of claim 5, wherein each of the first overwrap panel and the second overwrap panel is formed from a substantially rigid, foldable material.

16. The retention packaging system of claim 1, wherein each of the first overwrap panel and the second overwrap panel is formed from a substantially rigid, foldable material.

17. The sheet panel of claim 7, further comprising:

a central portion located between the first tension flap and the second tension flap;

wherein the central portion is attached to the sheet.

18. The sheet panel of claim 17, wherein the at least one detachable portion comprises:

a first detachable portion located between the first tension flap and the central portion before the first detachable portion is detached from the sheet panel; and a second detachable portion located between the second tension flap and the central portion before the second detachable portion is detached from the sheet panel.

19. The sheet panel of claim 18, wherein the central portion is attached to the sheet such that, when the first and second tension flaps are in the second position, the object is located between the base portion of the base panel and the central portion of the sheet panel.

20. The sheet panel of claim 6, wherein the first overwrap panel includes a first plurality of fold lines and the second overwrap panel includes a second plurality of fold lines.

21. The sheet panel of claim 20, wherein one of the first plurality of fold lines and one of the second plurality of fold lines are selectively aligned with ends of the first and second tension flaps, respectively, based on one or more of a desired tension of the sheet or a size of an object between the sheet and the base portion.

* * * * *